US007258116B2

(12) United States Patent
Searcy

(10) Patent No.: US 7,258,116 B2
(45) Date of Patent: Aug. 21, 2007

(54) BOTTOM VENTING FIREPLACE SYSTEM

(75) Inventor: Rebecca Ann Searcy, Minneapolis, MN (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/334,697

(22) Filed: Dec. 30, 2002

(65) Prior Publication Data

US 2004/0123859 A1 Jul. 1, 2004

(51) Int. Cl.
*F24C 3/00* (2006.01)
*F23J 11/00* (2006.01)

(52) U.S. Cl. ..... 126/85 B; 126/312; 126/512

(58) Field of Classification Search ..... 126/85 B, 126/307 R, 312, 512
See application file for complete search history.

(56) References Cited

U.S. PATENT DOCUMENTS 3,533,394 A 10/1970 Rose et al.
4,424,792 A 1/1984 Shimek et al.
4,793,322 A 12/1988 Shimek et al.
5,016,609 A 5/1991 Shimek et al.
5,053,148 A * 10/1991 von Bonin ..... 252/8.05
5,076,254 A 12/1991 Shimek et al.
5,218,953 A 6/1993 Shimek et al.
5,452,708 A 9/1995 Shimek et al.
5,571,008 A * 11/1996 Richardson et al. ..... 431/125
5,647,340 A 7/1997 Shimek et al.
5,673,683 A * 10/1997 Beal et al. ..... 126/531
5,941,237 A * 8/1999 Shimek et al. ..... 126/512
5,960,789 A 10/1999 Fleming
6,019,099 A 2/2000 Shimek et al.

(Continued)

FOREIGN PATENT DOCUMENTS

GB 2 194 632 3/1988

(Continued)

OTHER PUBLICATIONS http://www.centralfireplace.com/conews.html.*

(Continued)

*Primary Examiner*—Alfred Basichas
(74) *Attorney, Agent, or Firm*—Faegre & Benson LLP

(57) ABSTRACT

A fireplace having a bottom venting arrangement is disclosed. The fireplace includes a firebox having a burner and a combustion chamber. Fumes produced by burning of gas at the burner are pulled into an upper exhaust plenum in the upper portion of the firebox. The upper exhaust plenum is in fluid communication with the combustion chamber. The upper exhaust plenum is also in fluid communication with an upper end of a substantially vertical exhaust passage. The lower end of the exhaust passage is in fluid communication with a blower opening in a bottom panel of the firebox. An intake side of a blower is attached to the blower opening. The blower also includes a discharge side, which is coupled to an exhaust port on the fireplace. The blower operates when a fire is burning, and fumes containing combustion products are drawn into the upper exhaust plenum. From the upper exhaust plenum, the fumes travel into the exhaust passage, and then travel in a downward direction to the blower opening and into the blower intake. Fumes are then exhausted from the exhaust port and into an external ducting arrangement, from which the fumes are vented to the atmosphere.

29 Claims, 21 Drawing Sheets

U.S. PATENT DOCUMENTS

| | | | | |
|---|---|---|---|---|
| 6,145,502 | A * | 11/2000 | Lyons et al. | 126/512 |
| 6,257,230 | B1 | 7/2001 | Barudi et al. | |
| 6,374,822 | B1 * | 4/2002 | Lyons et al. | 126/512 |
| 6,463,926 | B1 | 10/2002 | Flick et al. | |
| 6,484,712 | B1 * | 11/2002 | Lyons et al. | 126/85 B |
| 2001/0042610 | A1 | 11/2001 | Lyons et al. | |

FOREIGN PATENT DOCUMENTS

| | | |
|---|---|---|
| GB | 2 199 126 | 6/1988 |
| JP | 05099463 A * | 4/1993 |

OTHER PUBLICATIONS http://www.centralfireplace.com/pd-fr-36-ins.html.*
http://www.centralfireplace.com/pd-fs-42-ins.html.*
"heatilator®, Owner's Manual and Installation Instructions, 1B75 B-Vent Gas Appliance" (venting instructions), Hearth & Home Technologies, Mt. Pleasant, IA, pp. 1, 7-9.

"heatilator®, Installation & Operating Instructions, Novus Series, B-Vent Gas Appliance" (venting instructions), Hearth & Home Technologies, Mt. Pleasant, IA, pp. 1, 7-10.

"heatilator®, Installation & Operating Instructions, Caliber B-Vent Series" (venting instructions), Hearth & Home Technologies, Mt. Pleasant, IA, pp. 1, 8-11.

"Heatilator®, Installation & Owner's Manual, Geneva Series B-Vent Gas Appliance" (venting instructions), Hearth & Home Technologies, Mt. Pleasant, IA, pp. 1, 8-11.

"Heat-N-Glo, Installers Guide, Models: 6000TRI" (venting instructions), Heat-N-Glo, Lakeville, MN, pp. 1, 12-25 (Sep. 2002).

"Heat-N-Glo, Installers Guide, Models: PIER-TVFL, ST-42TVFL" (venting instructions), Heat-N-Glo, Lakeville, MN, pp. 1, 16-18 (Jul. 2000).

"Heat-N-Glo, Installers Guide, Model: Infinity" (venting instructions), Heat-N-Glo, Lakeville, MN, pp. 1, 12-19 (Dec. 2002).

* cited by examiner

BOTTOM VENTING FIREPLACE SYSTEM

FIELD OF THE INVENTION

This invention relates generally to a venting system for a fireplace. More particularly, this invention relates to a bottom venting system for a fireplace.

BACKGROUND OF THE RELATED ART

Generally, fireplaces generate combustion products that must be vented from the structure where the fireplace is located. For example, if the fireplace is located in a house, the combustion products must be vented from the interior of the house to the atmosphere. Typically, the venting system includes a ducting arrangement coupled to the fireplace. The venting system uses a passive vertical or a direct vent collection arrangement to move fumes from a combustion chamber to the ducting arrangement of duct or pipe. The collection arrangement is located above the combustion chamber, taking advantage of the natural draft of the heated air in the fireplace to vent the combustion products. The combustion products are moved between the fireplace and atmosphere in the ducting arrangement that includes vertical, upward sections. The ducting arrangement is such that it allows the combustion products to rise due to the buoyant forces of the heated fumes, creating the velocity necessary to overcome the pressure drop through the venting system.

Fireplaces using a natural draft arrangement, such as the one described are limited in various aspects. The limitations are due to the fact that in a natural venting arrangement, the natural buoyancy of the hot air created by combustion moves the air in an upward direction. Such arrangements do not allow for air to be moved against the natural buoyant forces.

Limitations include, for example, where there may not be a suitable location in a structure to properly allow for a venting arrangement to be installed, because of, for example, space constraints. Such constraints do not allow for sufficient vertical, upward flow to induce drafting. Similarly, the structure may not have a roof that can support a vent or is situated such that a roof vent is impracticable, such as one that receives a large amount of snow. Additionally, some structures are desired that have no roof penetrations, to preserve aesthetics. Improvements are desired to over come these and other limitations.

SUMMARY OF THE INVENTION

One aspect of the present disclosure is directed to a fireplace system including a firebox. The firebox includes a combustion chamber fluidly connected to an upper exhaust plenum. The upper exhaust plenum collects combustion products from the combustion chamber. The fireplace system also includes a exhaust passage connecting the upper exhaust plenum and an exhaust vent. The exhaust vent is located below the firebox. The fireplace system also includes a blower arrangement disposed in a lower section of the firebox adjacent the exhaust vent.

Another aspect of the present disclosure is directed to an exhaust system for venting gases from a fireplace including a firebox. The exhaust system includes an intake manifold for removing the gases from the firebox. The exhaust system also includes means for moving gases from intake manifold to an exhaust vent. The exhaust system also includes an exhaust duct arrangement coupled to the exhaust vent for exhausting the gases to the atmosphere.

Another aspect of the present invention is a fireplace having a substantially sealed firebox. The sealed firebox includes a combustion chamber. The combustion chamber includes an upper panel and a side panel. An upper exhaust guide is coupled to the upper panel. Preferably, the upper exhaust guide includes first and second ends. The upper exhaust guide is coupled to the upper panel, creating an upper exhaust plenum therebetween. The upper exhaust guide includes one or more openings that allow combustion products to pass from the combustion chamber into the upper exhaust plenum. The first end of the upper exhaust guide fluidly communicates with an exhaust passage formed between a side exhaust guide and the side panel, wherein the side exhaust guide is located outside of the combustion chamber. The exhaust passage fluidly communicates with a blower arrangement coupled to the bottom of the firebox for exhausting combustion products out an exhaust port.

These and various other features as well as advantages which characterize the present invention will be apparent from a reading of the following detailed description and a review of the associated drawings.

BRIEF DESCRIPTION OF THE DRAWINGS

The organization and manner of the structure and operation of the invention, and advantages thereof, may best be understood by reference to the following description, taken in connection with the accompanying drawings, wherein like reference numerals identify like elements throughout the views, in which.

Figure 1:
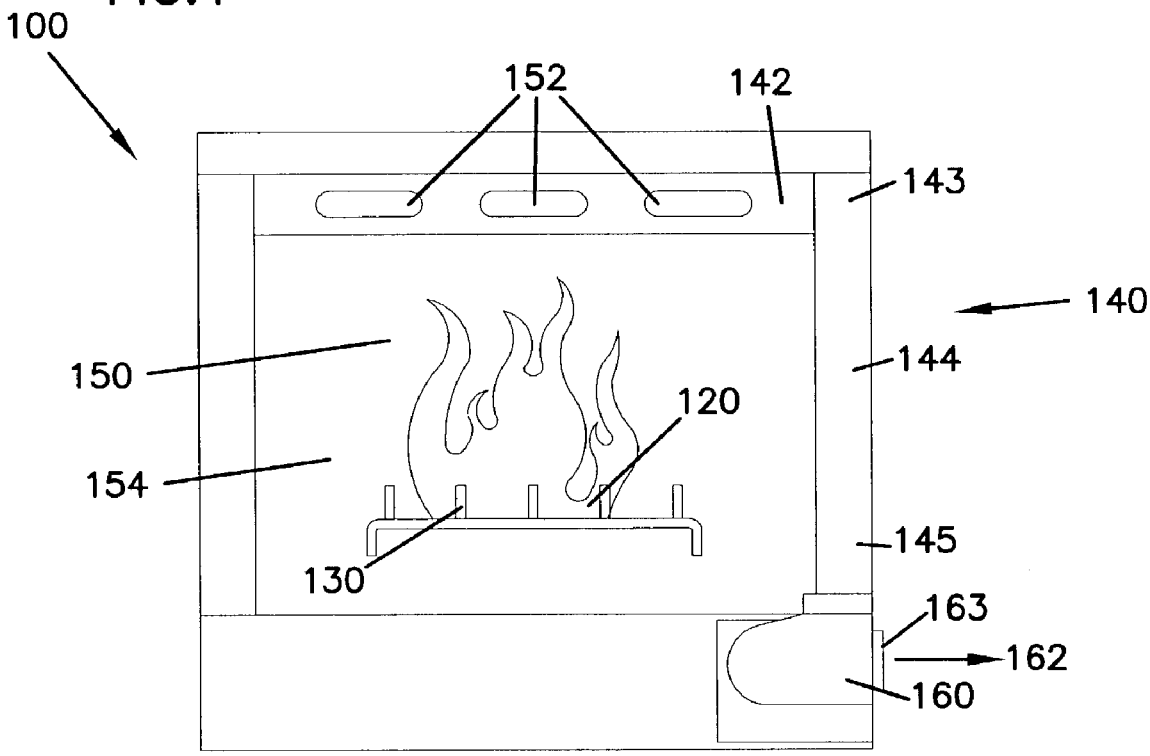
FIG. 1 is a schematic elevation view of a fireplace including a venting arrangement according to the present disclosure.
Figure 2A:
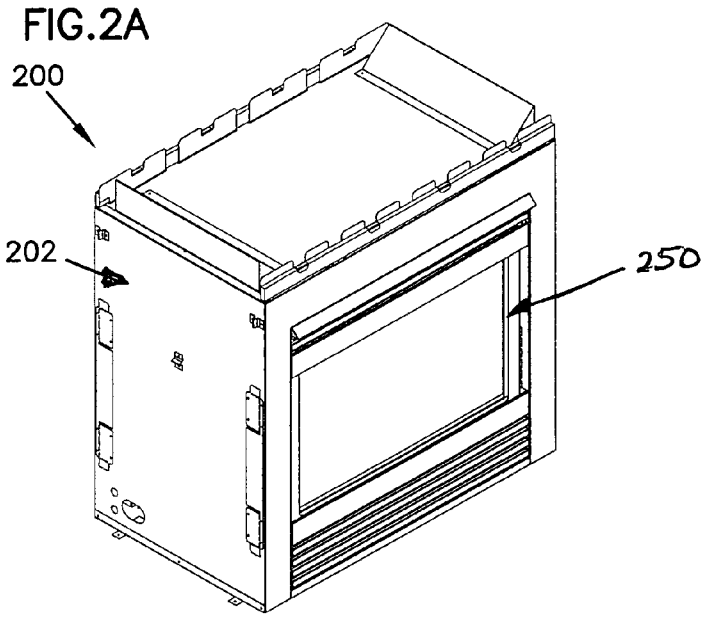
FIG. 2A is a perspective view of an example embodiment of a fireplace according to the present disclosure.
Figure 2B:
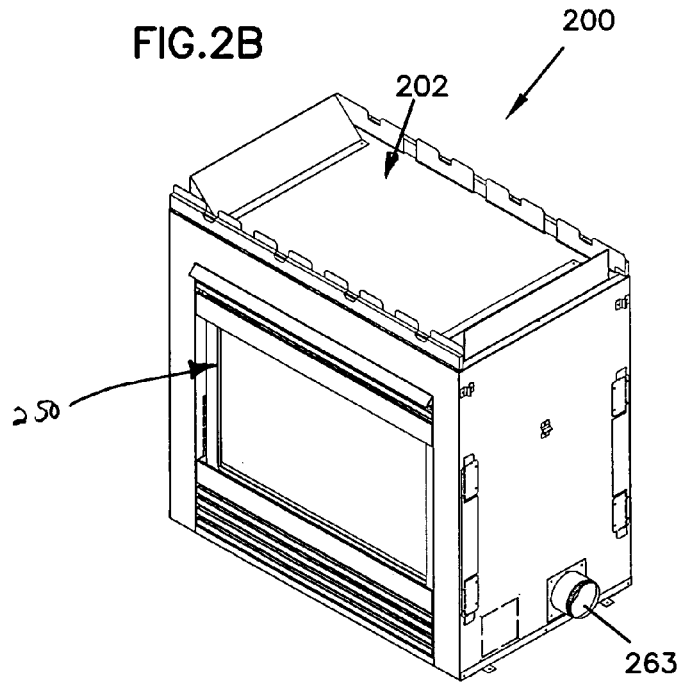
FIG. 2B is another perspective view of the fireplace of FIG. 2A according to the present disclosure.
Figure 3A:
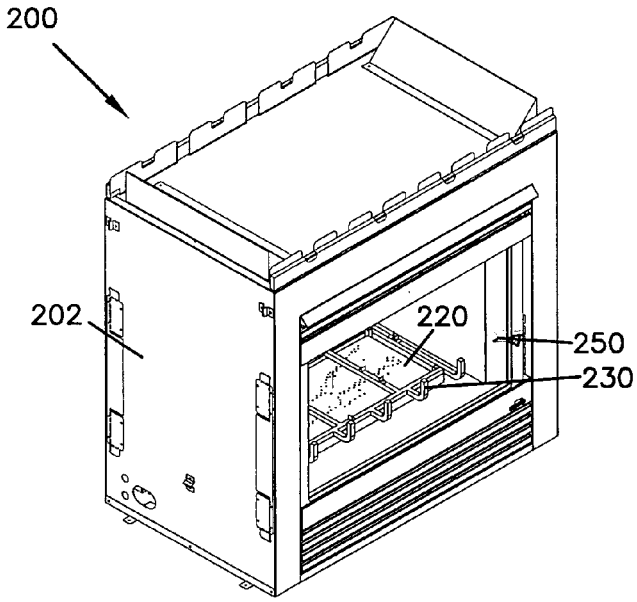
FIG. 3A is a perspective view of the fireplace of FIG. 2A showing details of a burner and grate assembly according to the present disclosure.
Figure 3B:
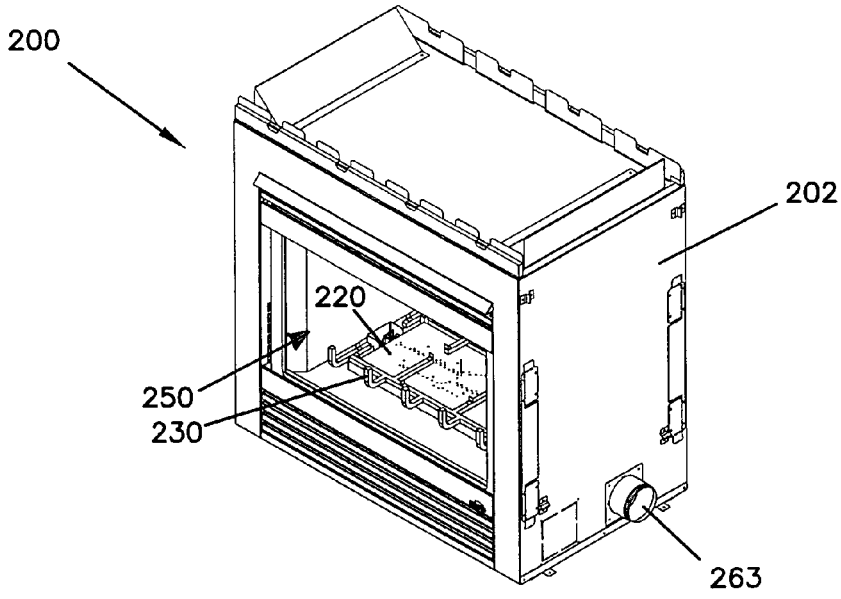
FIG. 3B is another perspective view of the fireplace of FIG. 3A according to the present disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE DISCLOSURE

In the following description of preferred embodiments of the present invention, reference is made to the accompanying drawings that form a part hereof, and in which is shown by way of illustration specific embodiments in which the invention may be practiced. It is understood that other embodiments may be utilized and structural changes may be made without departing from the scope of the present invention.

Generally, the present disclosure is directed to a fireplace including a firebox and an exhaust port for venting combustion products. The exhaust port is located below the firebox. The fireplace also includes a blower system to move the combustion products in a venting arrangement and exhaust the combustion products. The fireplace can be coupled to an external exhausting arrangement that includes downwardly directed vertical sections, and can also be used with an external horizontal exhaust termination. As used herein, the term "coupled" means any structure or method that may be used to provide connecting between two or more elements, which may or may not include a direct physical connection between the elements. The present invention can be used with various types of fireplace, including, for example, solid-fuel and gas. An advantage of the present invention is that it allows the fireplace to be used with ducting arrangements that include sections where the exhaust products are moved in a direction substantially opposite of the natural buoyancy forces of the warm combustion products.

Fireplace

Figure 18A:
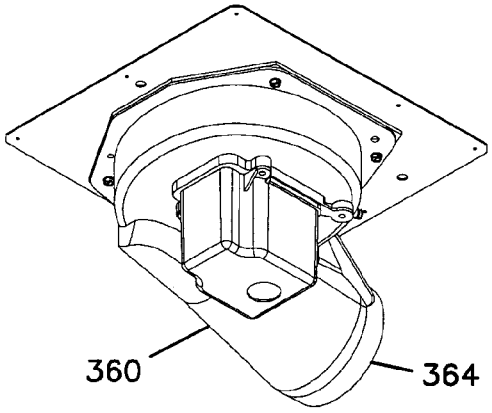
FIG. 18A is a close-up perspective view of a portion of an example embodiment of a blower mounted to a portion of a firebox according to the present disclosure.
Figure 18B:
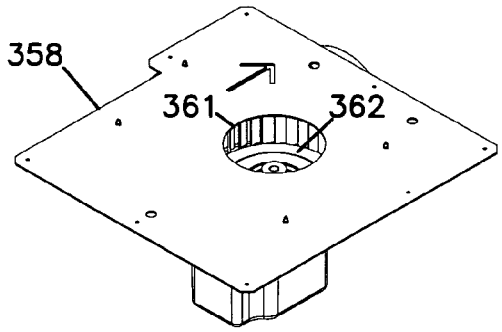
FIG. 18B is another perspective view of the blower mounted in FIG. 18A.
Figure 18C:
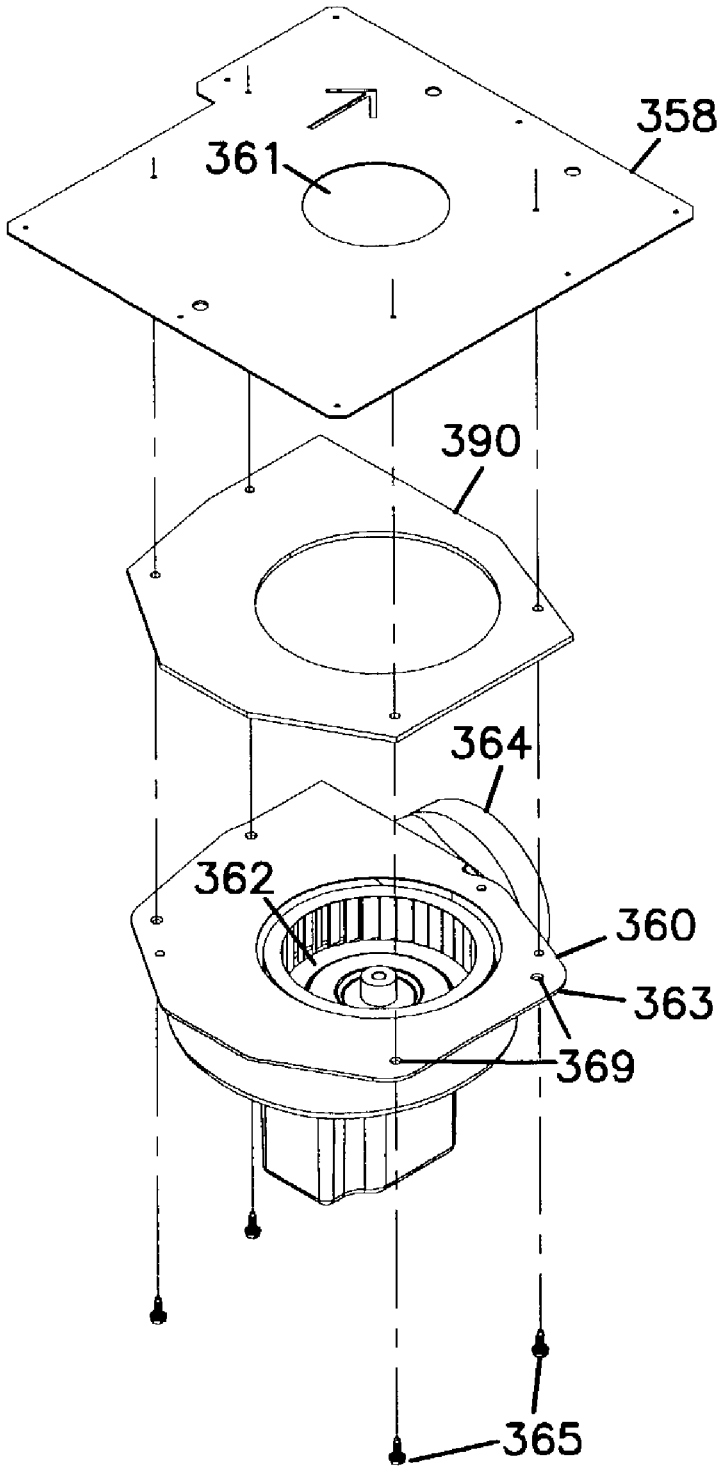
FIG. 18C is an exploded view of FIG. 18A.

Referring to FIG. 1, an example embodiment of a fireplace 100 (with the front section cut-away for illustrative purposes) having a horizontally vented exhaust arrangement 140 is shown. The fireplace 100 includes a firebox (or combustion chamber enclosure) 150 having a burner 120 and a grate 130. A combustible gas or fuel, for example natural gas or liquid propane gas, is delivered to the burner 120, which is located in a combustion chamber 154 that is defined by firebox 150, where it is then combusted. Combustion generates waste gases, which need to be vented from the fireplace 100. Combustion products generated by combustion of fuel, at the burner 120 are exhausted from the fireplace 100 via a venting or air guide arrangement 140. The venting arrangement 140 includes an upper exhaust guide 142, where combustion products are removed from the firebox 150 through firebox exhaust outlets 152. The upper exhaust guide 142 and exhaust outlets 152 cooperate to form a plenum or manifold for collecting combustion products, which can be of any suitable geometric arrangement suitable for use with the present invention. The exhaust outlets 152 are preferably located in the upper section of the combustion chamber, though any location that allows exhaust gases to be drawn into the exhaust outlets is suitable. The upper exhaust guide 142 fluidly communicates with an exhaust passage 144 that runs from top to the bottom of the firebox 150. The exhaust passage 144 includes an upper end 143 and a lower end 145. The upper end 143 of the exhaust passage 144 is in fluid communication with the upper exhaust guide 142. The lower end 145 of the exhaust passage 144 is in fluid communication with a blower arrangement 160 (such as seen in FIGS. 18A–C) located outside the firebox 150. The blower arrangement 160 is located below the upper exhaust guide 142, and is preferably located below the combustion chamber 154. The blower arrangement 160 includes an exhaust section 162. The exhaust section 162 is located adjacent an exhaust port 163 in the fireplace 100. The exhaust port 163 is connected to a ducting arrangement (not shown), various examples of which will be discussed hereinafter.

The blower 160 operates generally when the burner 120 in the fireplace 100 is operating, such that combustion products are taken in the firebox exhaust outlets 152 in the upper exhaust guide 142. The blower can also continue to run until a temperature sensor in the fireplace senses a pre-set temperature. This allows the blower to run for a time after the fire is extinguished. The combustion products are then moved downwardly from the upper exhaust guide 142 through the exhaust passage 144. The combustion products are then exhausted from the fireplace 100 through the exhaust port 163 and into an exterior ducting arrangement (not shown) to be exhausted to atmosphere. An advantage of the present disclosure is that the fireplace 100 can be located in a house or other structure unconstrained by the need for a vertical rise to get the natural draft, driven by the buoyant forces of the heated combustion products, of the fireplace 100 venting the combustion products. As will be described hereinafter, the present disclosure also allows for a ducting arrangement including downward runs of duct, which are not possible with a naturally vented fireplace. While in the example embodiment shown the exhaust port 163 is located below the firebox 150, it can be also be located adjacent the firebox 150. Similarly, while the example embodiment shows the exhaust port 163 passing through a sidewall of the fireplace 100, the exhaust port 163 could also be placed in other suitable locations, for example, the bottom of the fireplace 100.

The fireplace 100 is typically constructed from formed sheet metal parts that are connected together by sheet metal screws, rivets, spot welds, crimping or other equivalent means of connection, all of which is well-known in the art and does not form a part of the present invention.

Referring to FIGS. 2A–2B and 3A–3B, shown is an example embodiment of a fireplace 200 including a bottom vent 263. The fireplace 200 includes an outer shell 202 that houses the firebox 250 and other components. Insulation 291 (see FIG. 4) between the outer shell 202 and the firebox 250 keeps the surfaces of the outer shell 202 cool, and may further provide a sound dampening function to reduce noise generated within fireplace 200. The fireplace 200 also includes a burner assembly 220 in the firebox 250. The burner assembly 220 creates the flames from combustion of the fuel provided to the fireplace, typically LP or natural gas. A grate 230 is located adjacent to the burner assembly 220 and can hold decorative logs or rocks. The fireplace 200 includes a bottom vent port 263, which is coupled to an exhaust ducting arrangement to remove combustion products when the fireplace 200 is operating.

Firebox and Components

Figure 4:
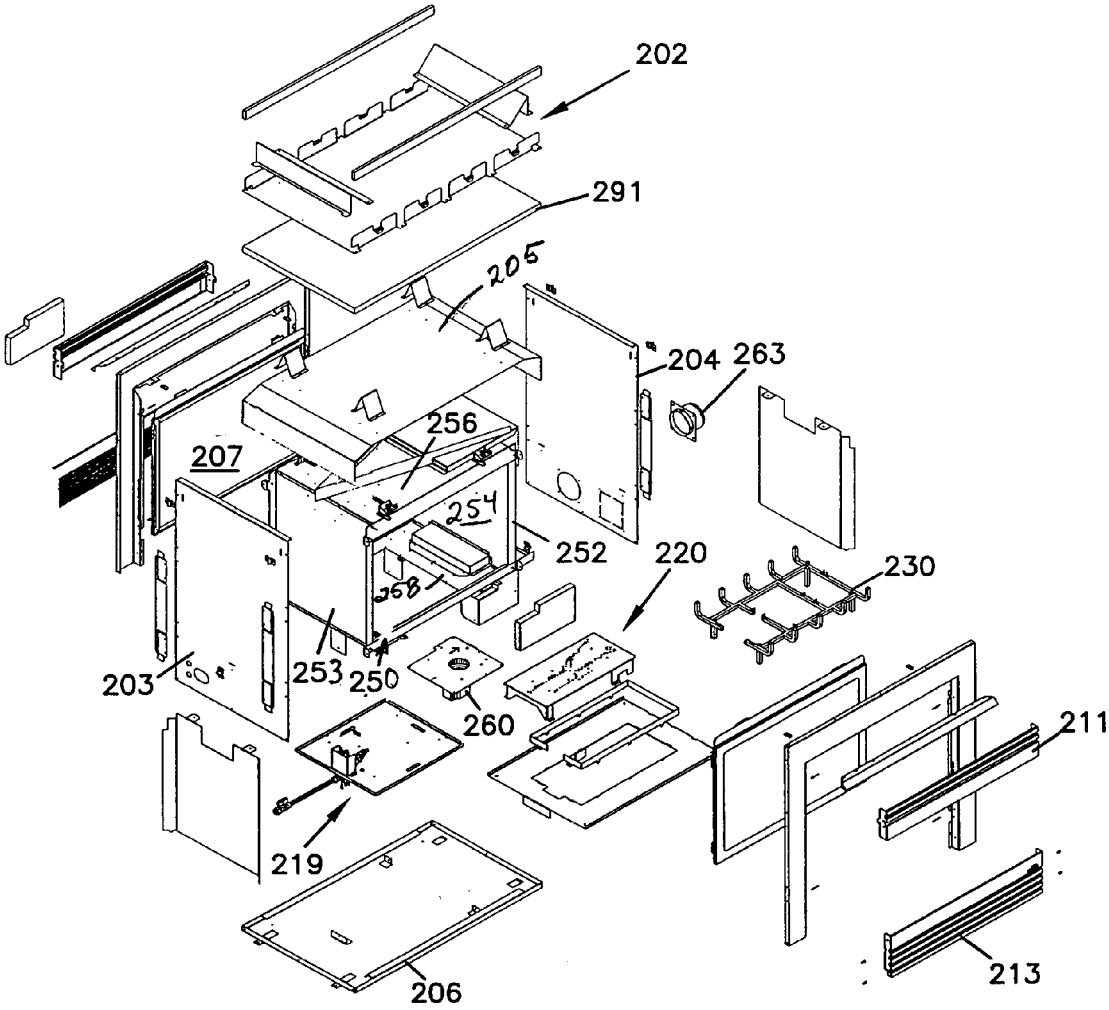
FIG. 4 is an exploded view of the fireplace of FIG. 1 according to the present disclosure.
Figure 5:
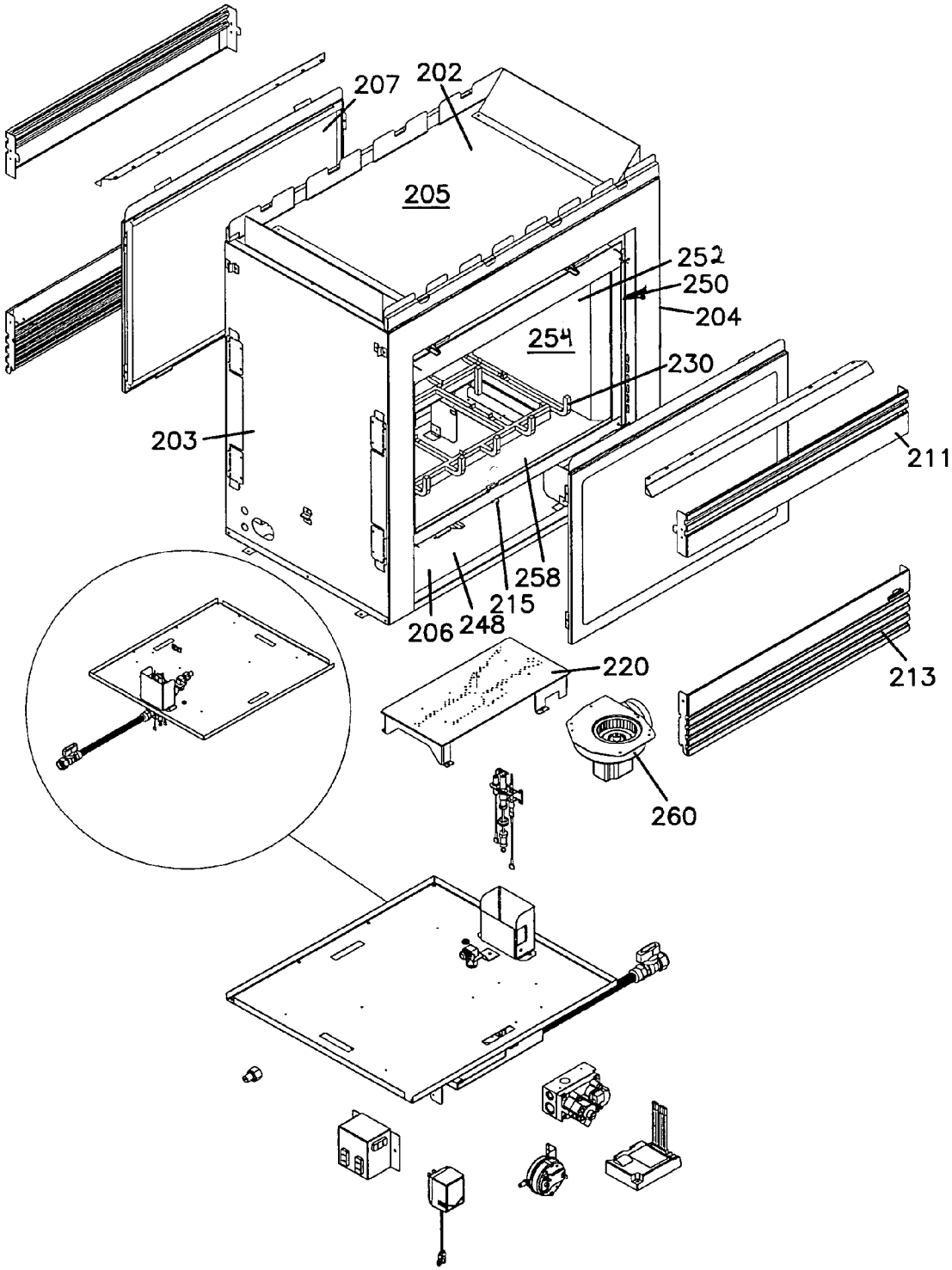
FIG. 5 is another exploded view of the fireplace of FIG. 4 according to the present disclosure.

Referring to FIGS. 4, 5 and 17 A–D, the firebox 250 is comprised of opposite right 252 and left 253 side panels, opposite top 256 and bottom 258 panels. The panels 252, 253, 256, 258 define a heat or combustion chamber 254 of the firebox 250 that is accessible through a front opening 215 of the fireplace 200. The heat chamber 254 contains the gas burner 220 as well as a decorative grate 230 and the gas logs or rocks (not shown) that cover the gas burner 220. A conventional-gas supply control assembly 219 controlling the supply of gas to the burner 220 is secured to the underside of the firebox bottom panel 258. Exhaust means 240 (see FIGS. 17A–B) exhaust combustion products or fumes from the combustion chamber 254.

The outer shell 202 encloses the firebox 250 and supports the firebox 250 in the outer shell 202 to create a heat exchange volume 248 between the exterior of the firebox 250 and the interior of the outer shell 202. The outer shell 202 includes opposite left 203 and right 204 side walls, opposite top 205 and bottom 206 walls and a rear wall 207. The walls are connected together surrounding the firebox 250. Top 211 and bottom 213 louvers extend between the outer shell 202 side walls 203, 204 above and below the access opening 215 of the firebox 250. Ambient room air is drawn into the heat exchange volume 248 through the bottom vent louver 213 and the heated air is then returned into the room out through the top vent louver 211.

Firebox & Air Passage

The firebox 250 contains exhaust outlets 257 (see FIG. 17C) in the upper part of the firebox 250. The exhaust outlets 257 fluidly couple the combustion chamber 254 to an upper exhaust plenum 255 formed between the upper panel 205 of the firebox 250 and an upper exhaust guide 270. Combustion products are pulled into the upper exhaust plenum 255 by operation of a blower 260 (see FIGS. 4 and 5) located adjacent the exhaust port 263. The upper exhaust plenum 255 is fluidly coupled to a substantially vertical exhaust passage 244 between the upper exhaust plenum 255 and the blower 260. The exhaust passage 244 allows combustion products to pass from the upper exhaust plenum 255 to the blower 260 and then out the exhaust port 263, with the combustion products traveling in a downward direction. With the blower 260 operating, combustion products are drawn from the combustion chamber 254 into the upper exhaust plenum 255, through the exhaust passage 244 and then through the blower 260 and out the exhaust port 263. Preferably, the combustion products are exhausted from the exhaust port 263 into a ducting arrangement, various embodiments of which will be described hereinafter. An advantage is that the blower 260 allows the fireplace 200 to exhaust to a ducting arrangement having an initial horizontally oriented section coupled directly to the exhaust port 263, which is not possible with naturally vented fireplaces. Another advantage of the present disclosure is that it allows placement and operation of a fireplace that may not otherwise be possible using natural ventilation methods and apparatuses. For example, referring to FIG. 7, the fireplace of the present disclosure can be installed within 9 inches of a wall when using a 4-inch 90-degree elbow and a 4-inch vent pipe, including a 1-inch clearance between the pipe and the wall.

Air Passage

Figure 17A:
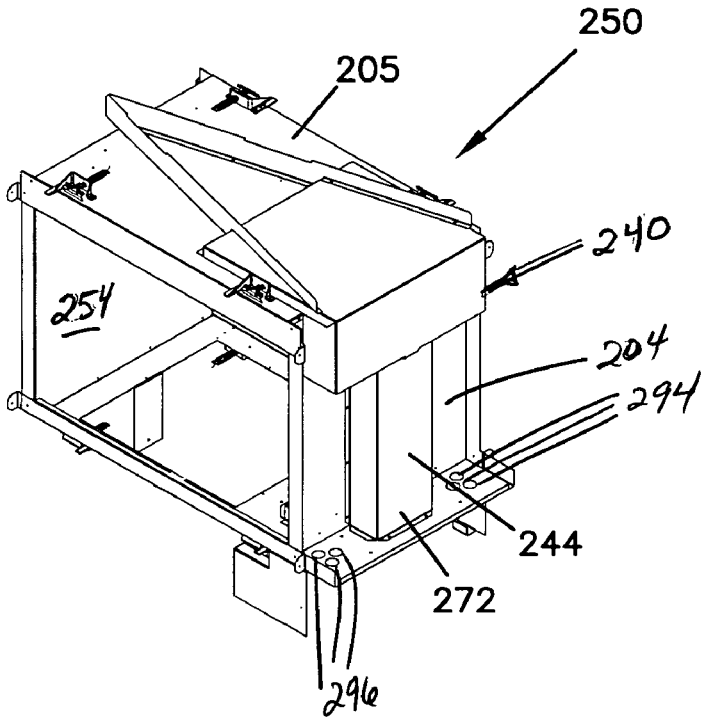
FIG. 17A is a perspective view of an example embodiment of a firebox including a venting assembly according to the present disclosure.
Figure 17B:
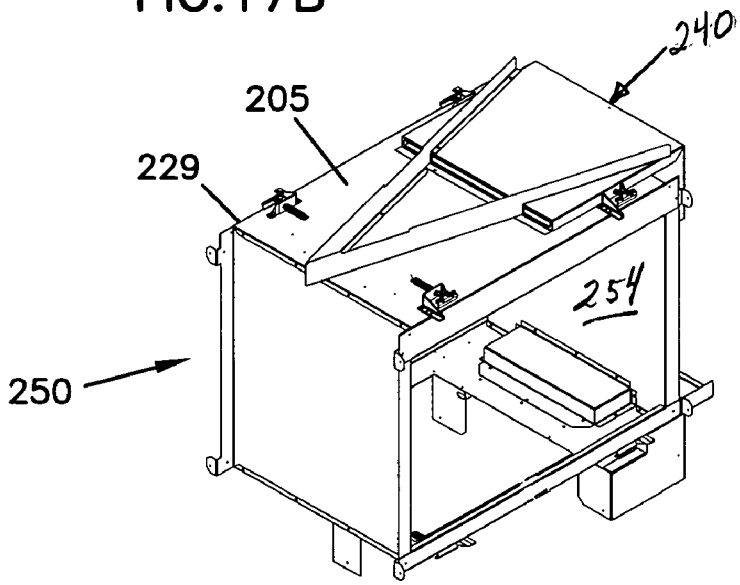
FIG. 17B is another perspective view of the firebox of FIG. 17A.
Figure 17C:
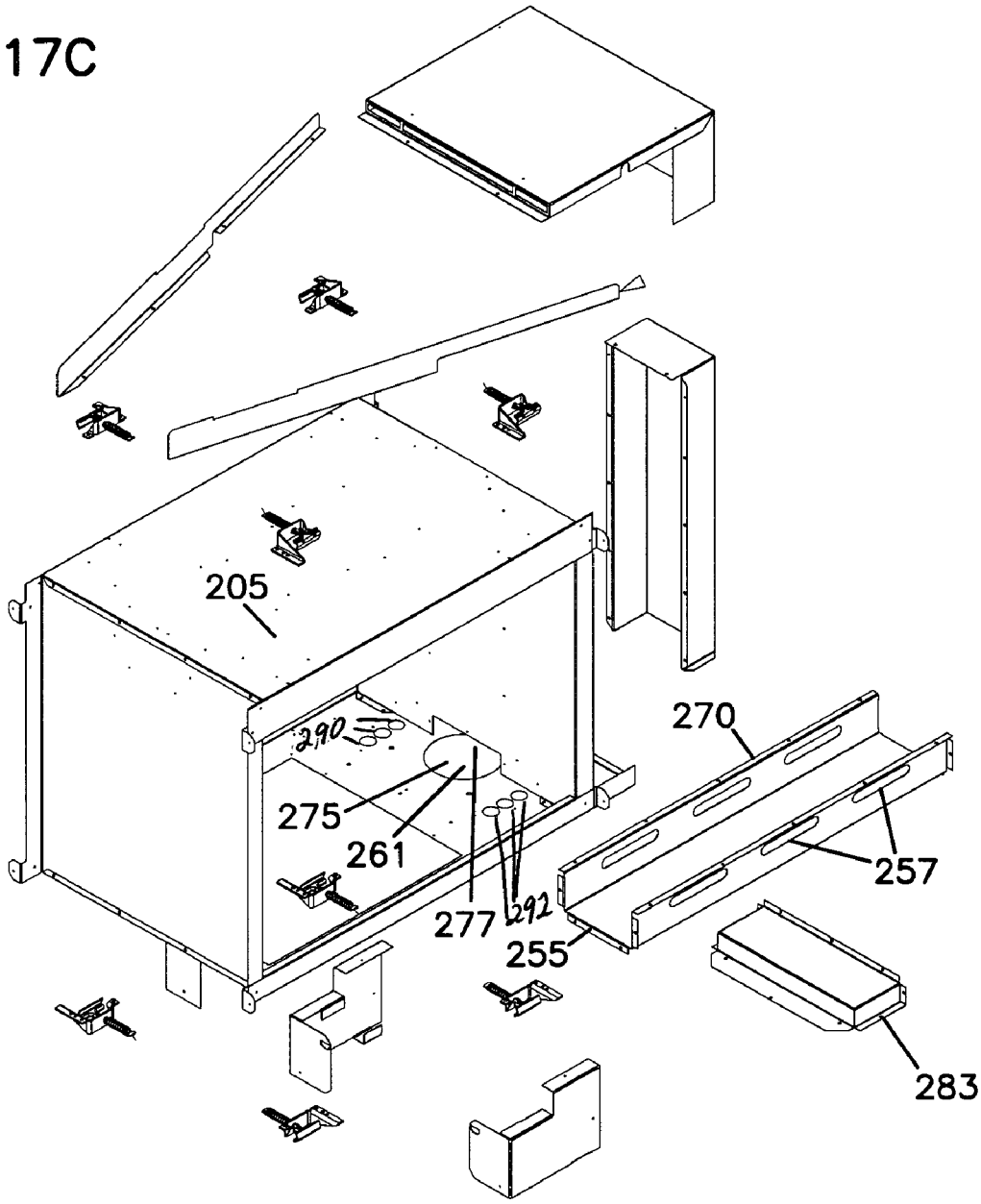
FIG. 17C is an exploded view of the firebox of FIG. 17A.
Figure 17D:
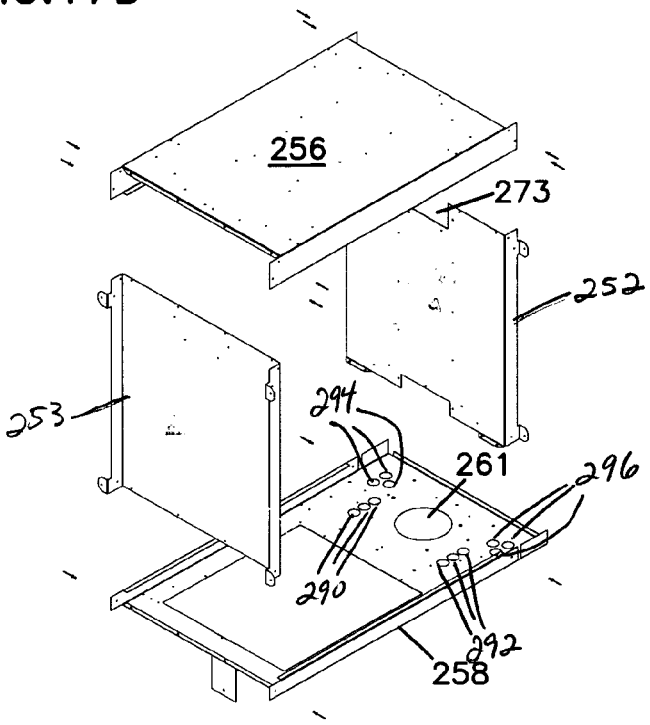
FIG. 17D is an exploded view of a portion of the firebox of FIG. 17A.

Referring to FIGS. 17A–C, the firebox 250 includes the upper exhaust plenum 255, exhaust passage 244 and a blower intake opening 261. The firebox 250 also houses the combustion chamber 254. Coupling the upper exhaust guide 270 to the upper panel 205 of the firebox 250 forms the upper exhaust plenum 255. The upper exhaust guide 270 can be coupled directly to the panel 205 by welding or fasteners. The upper exhaust plenum 255 is in fluid communication with the combustion chamber 254, and gases and/or combustion products can pass freely between the same. A side exhaust guide 272 is attached to a side panel 204 of the firebox 250 and exhaust passage 244 is formed therebetween. An opening 273 in the side panel of the firebox 250 (shown in FIG. 17D) allows the upper exhaust plenum 255 and exhaust passage 244 to be in fluid communication. The exhaust passage 244 is in fluid communication with the blower opening 261, which is preferably located in the bottom panel 258 of the firebox 250. In the example embodiment shown, the blower opening 261 is located under the side panel 252 of the firebox 250, with a portion 275 inside the combustion chamber 254 and a portion 277 outside the combustion chamber 254. To isolate the blower opening 261 from direct exposure to the combustion chamber 254, a bottom air guide 283 is attached to the side panel 252 and the bottom panel 258 of the firebox 250. The bottom air guide 283 is not required when the blower opening 261 is located completely outside the combustion chamber 254.

Blower

Figure 19:
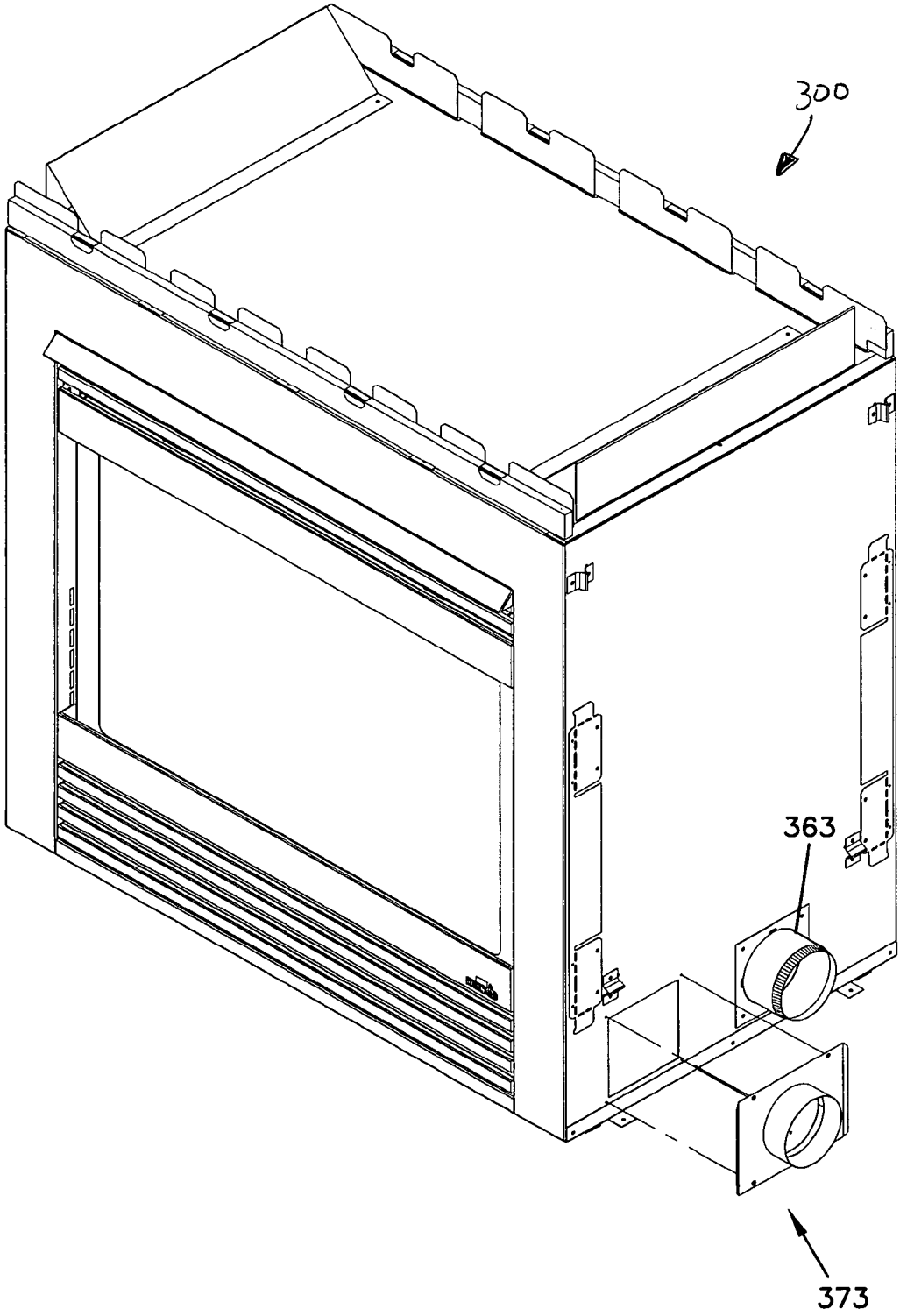
FIG. 19 is a perspective view of an example embodiment of a fireplace including a make-up air return according to the present disclosure.

Referring to FIGS. 18A–C, a blower 360 is shown coupled to the blower opening 361. The blower 360 is preferably a centrifugal blower including an intake 362 and a discharge 364. The portion of the blower 360 including the intake 362 is coupled to the bottom panel 358 of the firebox. A mounting plate 363 on the blower 360 includes fastener holes 369 for receiving fasteners 365, such as a nut and bolt, metal screws, or rivets. The blower 360 is mounted adjacent the blower opening 361. Optionally, a seal member 390, such as a gasket, is disposed between the mounting plate 363 and the bottom panel 358. Other air movement means can be used in the place of a centrifugal blower, for example, draft induced blowers, crossflow blowers, or axial fans, as long as it induces proper airflow to exhaust the combustion products from the fireplace. Preferably, the blower is a centrifugal blower. More preferably, the blower is a centrifugal blower that moves about 95–115 cubic feet per minute of air out of the exhaust port of the fireplace, such as part number 119-259-00 available from Jakel, Inc. Since the blower 360 is venting air from the fireplace 300 at a high rate, make-up air to support combustion is brought in through a make up air opening 373 (such as that shown in FIG. 19). The make-up air opening 373 can be constructed to bring in outside make-up air, such as from an external vent, or can use room air directly. Optionally, make-up air can also be brought in from another opening, for example, the louvers 211, 213 shown in FIGS. 4 and 5 thereby balancing the air circulating in the inner heat exchange volume between the outer shell and the firebox. Balancing the air also keeps the flame from being extinguished.

Referring now to FIGS. 4, 5 and 17A–17C, some of the make-up air available in the space between the outer shell and the firebox of the fireplace (the make-up air being provided by the air opening 373 and through the louvers 211, 213) may be drawn into the air passage 244 through cooling apertures 290, 292 under suction forces of the blower 260. The cooling apertures are shown positioned adjacent to the blower intake opening 261. The bottom air guide 283 provides a passage for fluid communication between the apertures 290, 292 and the intake opening 261. As a result of this fluid communication, relatively cool fresh air available through the air opening 373 and the louvers 211, 213 can be drawn into and cool the relatively hot combustion gases prior to the combustion gases entering the blower. Typically, combustion gases with excessive temperatures can damage a blower or other features of the fireplace. Therefore, the example configuration described herein can provide an advantage of cooling the hot combustion gases by mixing cool combustion air (available for combustion of fuel in the firebox 250) or other sources of cool intake air with the hot combustion gases.

The example configuration described above also provides an added advantage of cooling the combustion gases prior to the combustion gases leaving the outer shell 202. As a result, the vent system that transfers the combustion gases away from the fireplace 200 (e.g., ducting arrangement 610 described below) requires less insulation and heat protection from the building structure through which the vent system passes. The example configuration also provides an option of providing combustion air from multiple sources and using combustion air from one or more of these sources to mix with the hot combustion gas prior to the combustion gases being passed through the blower. The sources of combustion air may be kept separate from each other so, for example, one source of combustion air may be used in the combustion chamber for the combustion of fuel and the other source may be used primarily or exclusively for cooling of combustion gases just before the combustion gases are drawn through the blower.

The firebox 250 may also include a plurality of apertures 294, 296 (see FIGS. 17A, 17D) that provide combustion air into a space surrounding the exhaust passage 244. The presence of relatively cool combustion air around the exhaust passage 244 provides a heat exchanging configuration in which heat from the hot combustion gases passing through the exhaust passage 244 is transferred through a wall of the exhaust passage 244 into the cool combustion air. The heated combustion air may then exit out of the louver 211 due to the natural buoyancy forces of the heated air, or may be drawing into the combustion gases via the cooling apertures 290, 292, or may be drawn into the combustion chamber for combustion as described above.

Another advantage of the example embodiments described herein is the need for only a single blower to provide combustion air into the combustion chamber, remove combustion gases from the combustion chamber, cool the combustion gases before being drawn into the blower, and exhaust the combustion gases to a remote location. Many known systems require at least two blowers to perform these several functions; for example, one blower to draw out and exhaust combustion gases, and a second blower to move cool air across heat exchanging plenum surfaces within the fireplace for the purpose of cooling the hot combustion gases.

Referring to FIGS. 4, 5, 17 A–D and 18 A–C, if the blower 260 were replaced by blower 360, when the blower 360 is operating, gases in the exhaust passage 244 above the blower opening 361 is sucked into the intake 362 of the blower 360. The gases are then discharged out the discharge 364 side. The discharge 364 is coupled, preferably directly, to the exhaust port 363 in the fireplace 200. In this manner, the combustion products are continuously removed from the combustion chamber 254 when the fireplace 200 is operating. The blower 360 allows the fireplace 200 to be connected to a ducting arrangement that includes long horizontal sections of duct and even downward sections where the fluid flow in the duct is traveling in the direction opposite to the natural buoyancy forces. Several example embodiments of ducting arrangements useful with the fireplace of the present disclosure follow.

Ducting Arrangements

Referring to FIGS. 6–12, various exemplary embodiments of ducting arrangements are described. An advantage of the fireplace of the present disclosure is that is can be used with a ducting arrangement that includes with a vertical or a horizontal termination. Another advantage is that the ducting arrangement for exhausting combustion products from the fireplace can contain sections where the combustion products are flowing in a downward direction.

Figure 6:
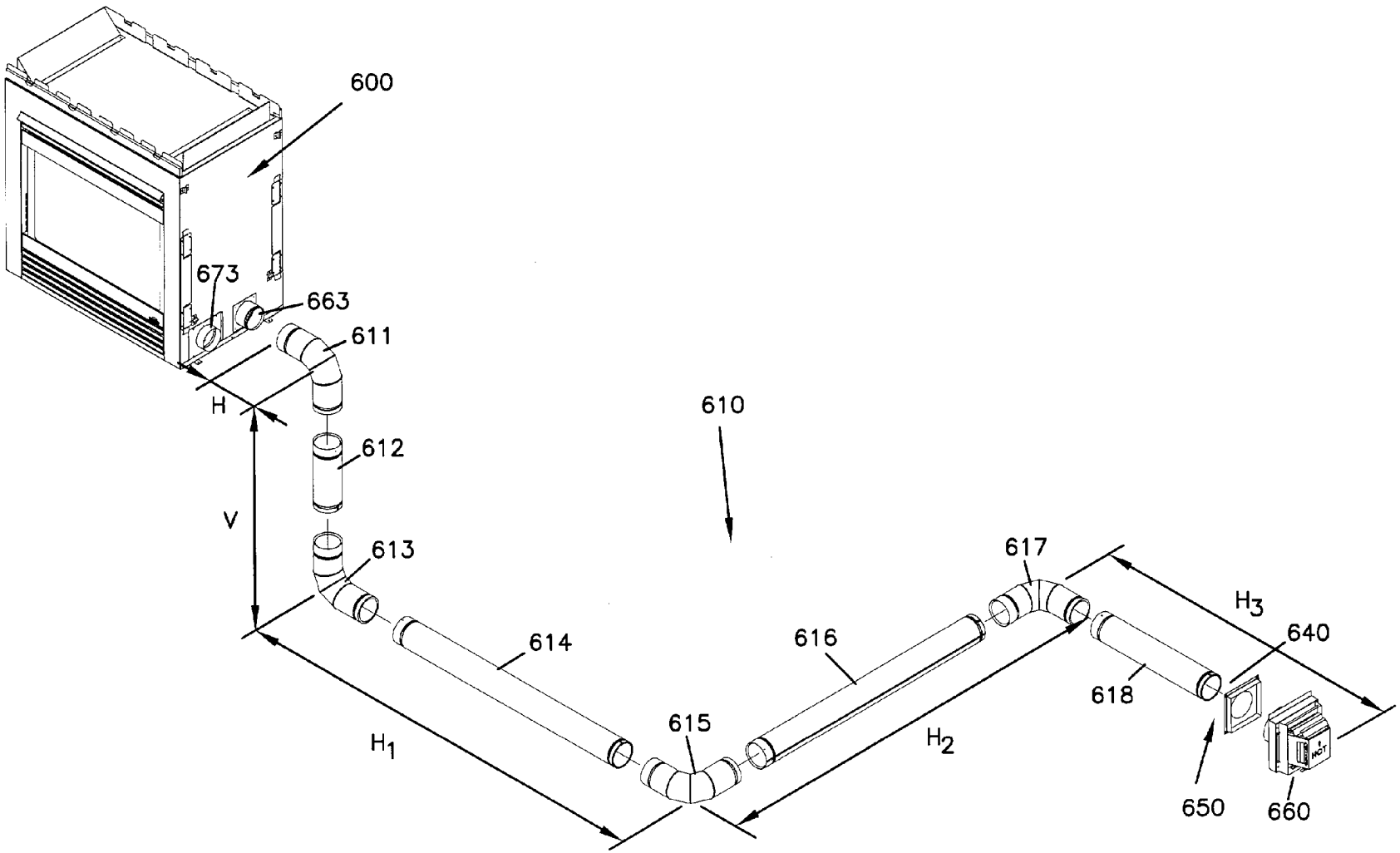
FIG. 6 is an example embodiment of a fireplace including a bottom vent having an example embodiment of a venting arrangement according to the present disclosure.

Referring to FIG. 6, a fireplace 600 including a horizontal bottom vent 663 is shown. The bottom vent 663 is fluidly coupled to a ducting arrangement 610. The ducting arrangement 610 includes a first 90-degree elbow 611 connected to the bottom vent 663. The first elbow 611 is also connected to a downward section 612 of pipe. The downward section 612 is also connected to a second 90-degree elbow 613. The second elbow 613 directs the incoming downward vertical flow of combustion products into a first horizontal flow section 614. The first horizontal flow section 614 is also connected to a third 90-degree elbow 615, which is in turn also connected to a second horizontal flow section 616. The second horizontal flow section 616 is also connected to a fourth 90-degree elbow 617. The fourth 90-degree elbow 617 is connected by a horizontal section 618 to a termination point 640, which exhausts the combustion products through a horizontal vent 650 covered by a horizontal vent cap 660.

Using a blower that moves approximately 100 to 115 cubic feet of fluid per minute through the ducting arrangement 610 shown, the total horizontal distance that the vent cap can be from the fireplace is about 32 feet, with a maximum vertical downward distance of about 3 feet.

Figure 7:
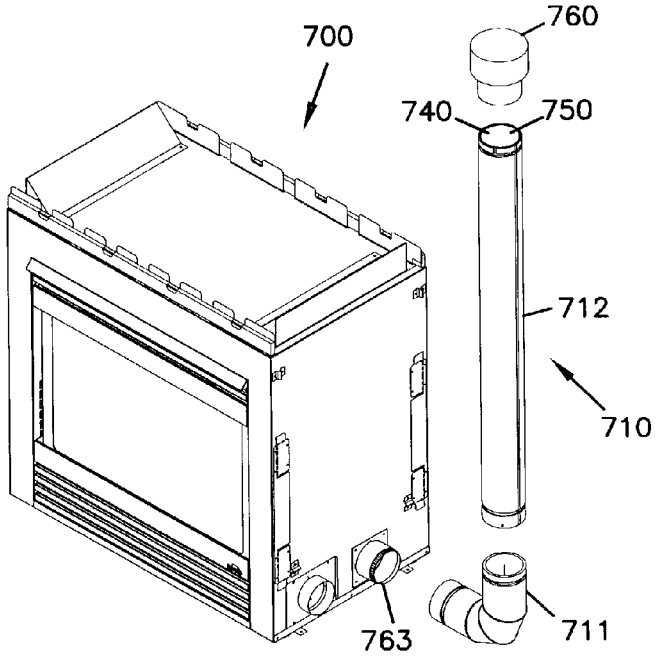
FIG. 7 is an example embodiment of a fireplace including a bottom vent having another example embodiment of a venting arrangement according to the present disclosure.

Referring to FIG. 7, a fireplace 700 including a bottom vent 763 coupled to ducting arrangement 710 is shown. The ducting arrangement 710 includes a 90-degree elbow 711 connected to the bottom vent 763. The 90-degree 711 elbow directs the combustion products from the horizontal bottom vent 763 into a vertical section 712 of pipe. The combustion products pass from the pipe 712 to a termination point 740, which exhausts the combustion products through a vertical vent 750 covered by a vent cap 760.

Using a blower that moves approximately 100 to 115 cubic feet of fluid per minute through the ducting arrangement 710 shown, the total vertical distance that the vent cap can be from the fireplace 700 is about 45 feet above the exhaust port. This is when using a standard 4-inch diameter duct. It is within the skill of one in the art to select fluid when using an alternative duct size.

Figure 8:
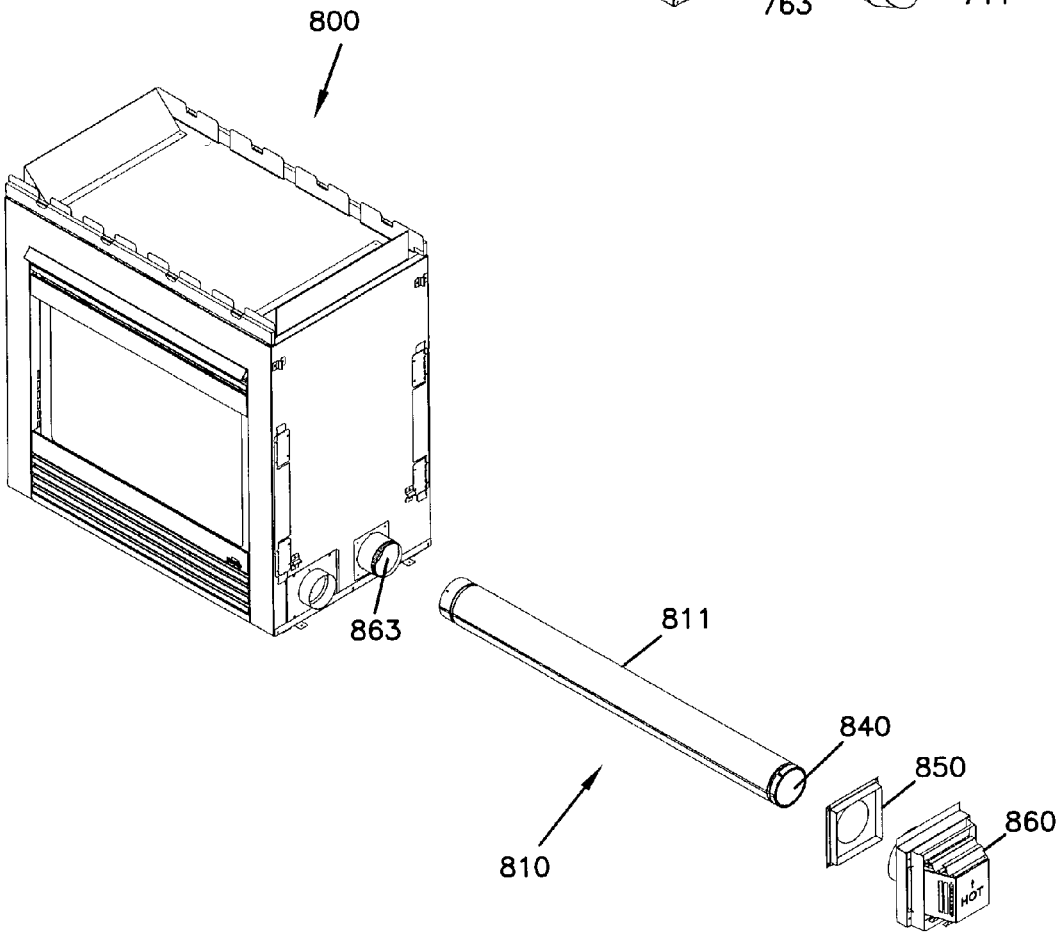
FIG. 8 is an example embodiment of a fireplace including a bottom vent having another example embodiment of a venting arrangement according to the present disclosure.

Referring to FIG. 8, a fireplace 800 including a bottom vent 863 coupled to ducting arrangement 810 is shown. The ducting arrangement 810 includes a horizontal section 811 that is connection to a termination point 840, which exhausts the combustion products through a horizontal vent 850 covered by a horizontal vent cap 860. The example embodiment fireplace 800 described, using a 4-inch pipe, can be located up to about 40 feet from the termination point 840, with a minimum distance of about 2 feet.

Figure 9:
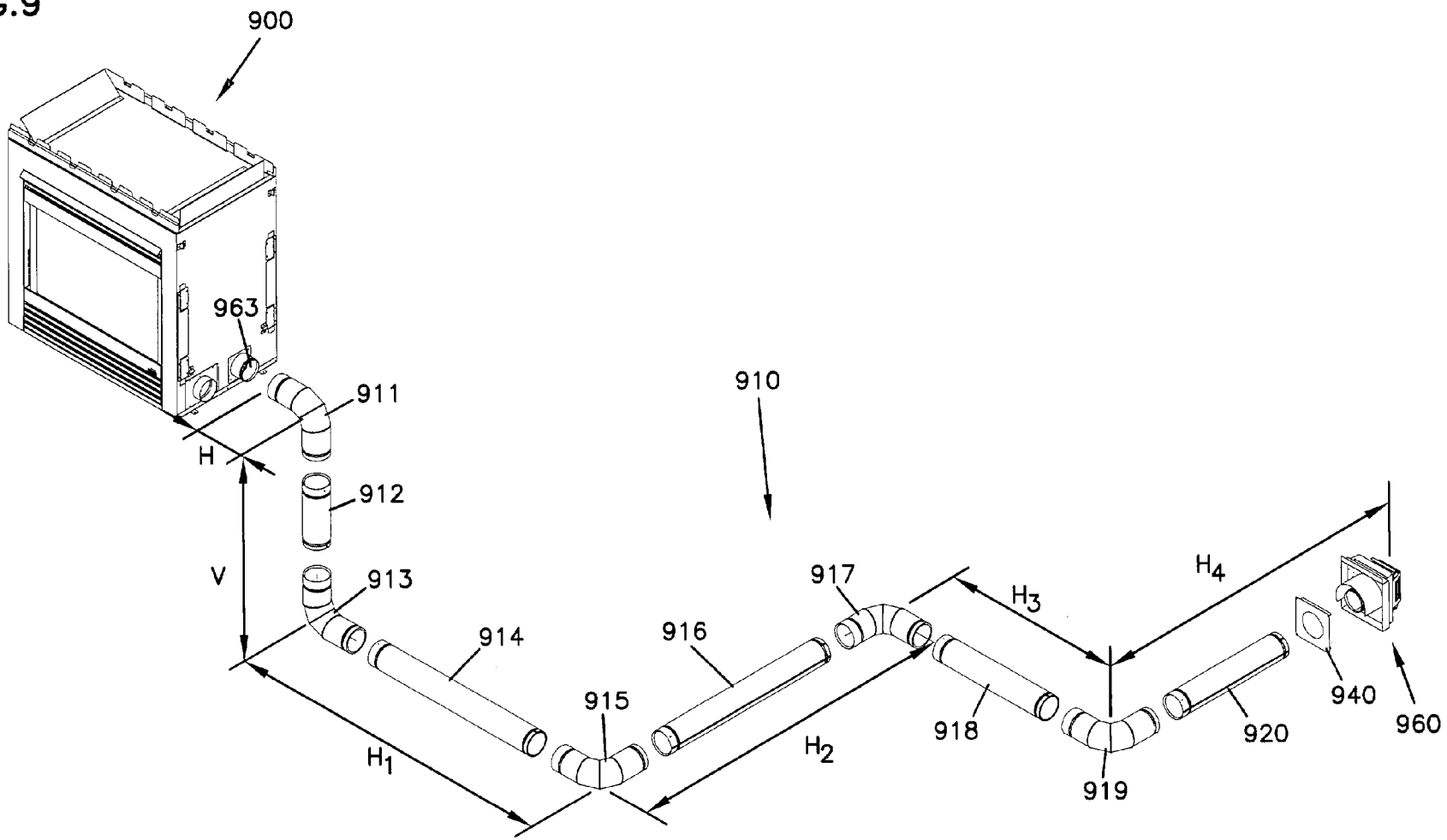
FIG. 9 is an example embodiment of a fireplace including a bottom vent having another example embodiment of a venting arrangement according to the present disclosure.

Referring to FIG. 9, a fireplace 900 includes a first 90-degree elbow 911 a downward section 912, a second 90-degree elbow 913, a first horizontal flow section 914, a third 90-degree elbow 915, a second horizontal flow section 916, a fourth 90-degree elbow 917, and a horizontal section 918. Fireplace 900 also includes a bottom vent 963 coupled to ducting arrangement 910, similar to the example embodiment shown in FIG. 6, is shown. The ducting arrangement 910 includes a fifth 90-degree elbow 919 connected to the end of the third horizontal section 919. The fifth 90-degree elbow 919 is also connected to a fourth horizontal section 920, which in turn is connected to a termination point 940 covered by a horizontal vent cap 960.

Using a blower that moves approximately 100 to 115 cubic feet of fluid per minute through the ducting arrangement 910 shown, the total horizontal distance that the vent cap can be from the fireplace is about 35 feet, with a maximum downward distance of 3 feet from the exhaust port to the vent cap.

Figure 10:
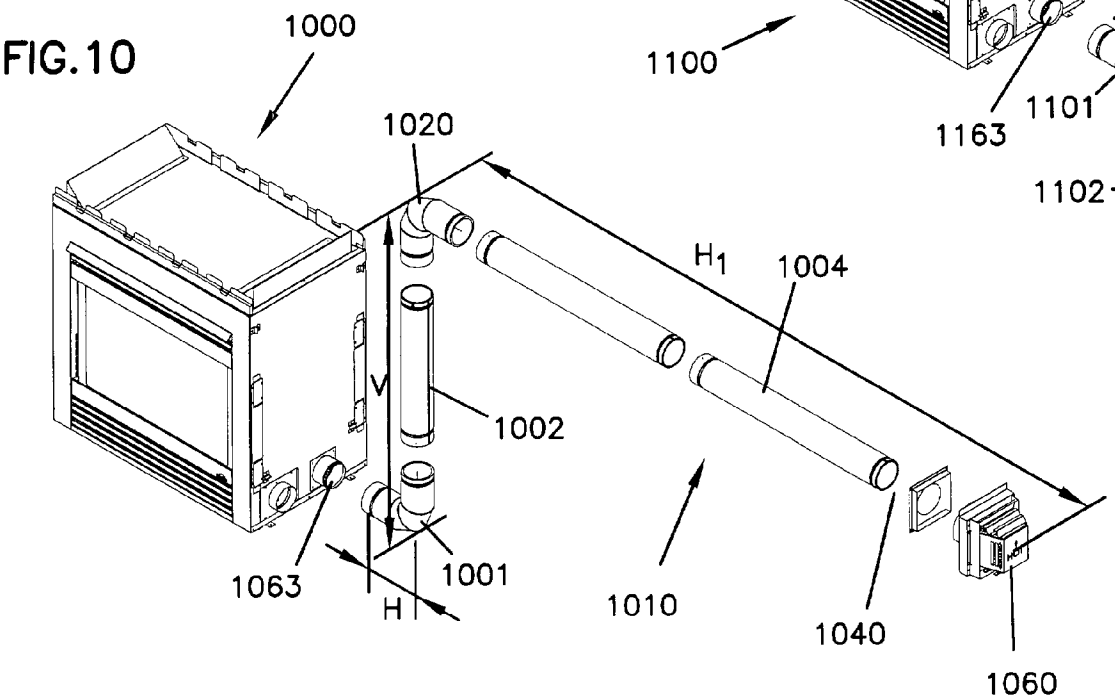
FIG. 10 is an example embodiment of a fireplace including a bottom vent having another example embodiment of a venting arrangement according to the present disclosure.

Referring to FIG. 10, a fireplace 1000 including a bottom vent 1063 coupled to ducting arrangement 1010 is shown. The ducting arrangement 1010 includes a first elbow 1001 connected to the bottom vent 1063. The first elbow 1001 directs the horizontal flow of combustion products from the fireplace 1000 into an upward vertical section 1002 of pipe. An elbow 1020 connects upward section 1002 to a horizontal section 1004 which is in turn connected to a termination point 1040, where combustion products are vented. A horizontal cap 1060 covers the termination point 1040.

Using a blower that moves approximately 100 to 115 cubic feet of fluid per minute through the ducting arrangement shown, the total horizontal distance that the vent cap can be from the fireplace is about 35 feet, with a maximum downward distance of about 35 feet from the exhaust port to the vent cap. The total of the vertical and horizontal and vertical sections in this arrangement should be less than 38 feet.

Figure 11:
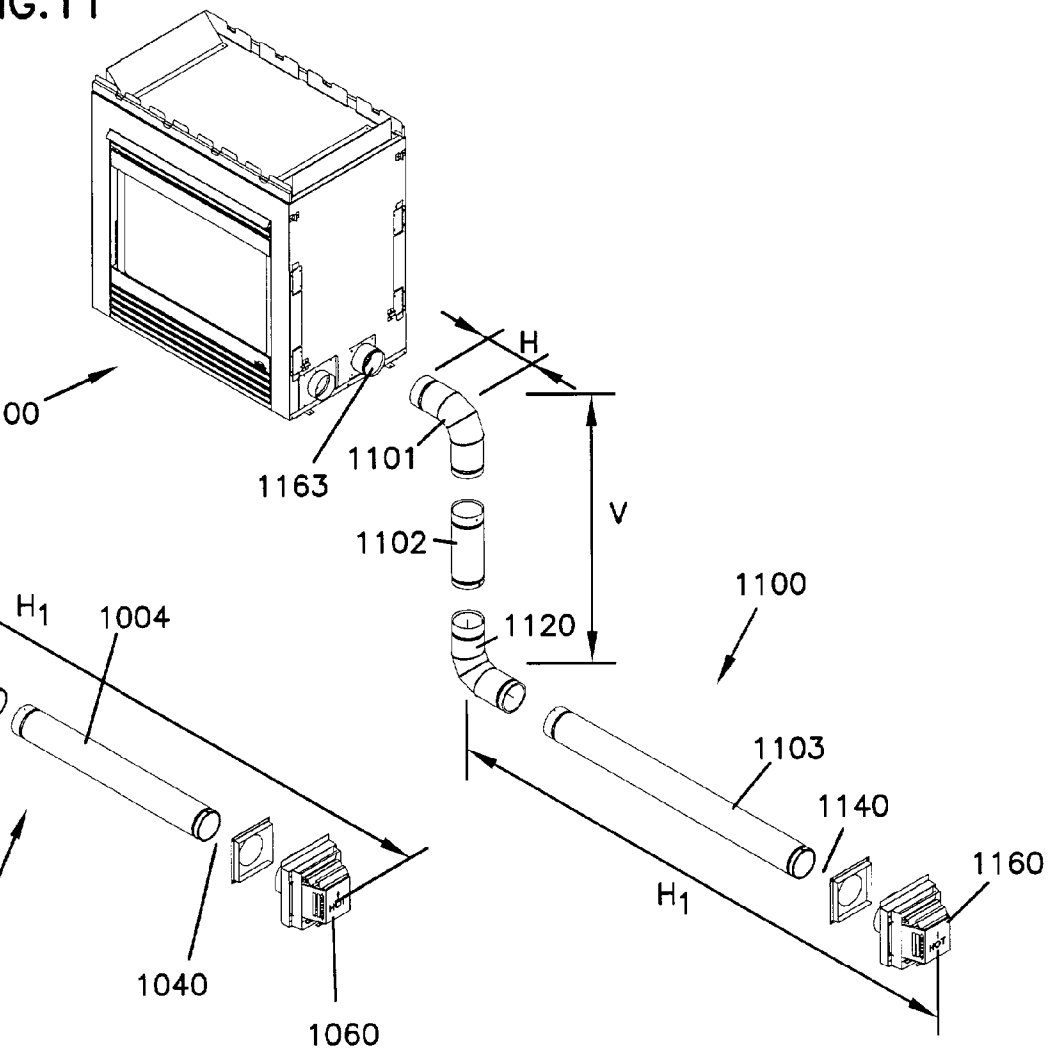
FIG. 11 is an example embodiment of a fireplace including a bottom vent having another example embodiment of a venting arrangement according to the present disclosure.

Referring to FIG. 11, a fireplace 1100 including a bottom vent 1163 coupled to ducting arrangement 1100 is shown. The ducting arrangement 1100 is similar to the one shown in FIG. 10, except that the first elbow 1101 directs the horizontal flow of combustion products from the fireplace 1100 into a vertical downward section 1102 of pipe. An elbow 1120 connects the downward section 1102 to a horizontal section 1103 that is connected to a termination point 1140 where combustion products are vented. A horizontal cap 1160 covers the termination point 1140.

Using a blower that moves approximately 100 to 115 cubic feet of fluid per minute through the ducting arrangement shown, the total horizontal distance that the vent cap can be from the fireplace is about 35 feet, with a maximum downward distance of about 3 feet from the exhaust port to the vent cap.

Figure 12:
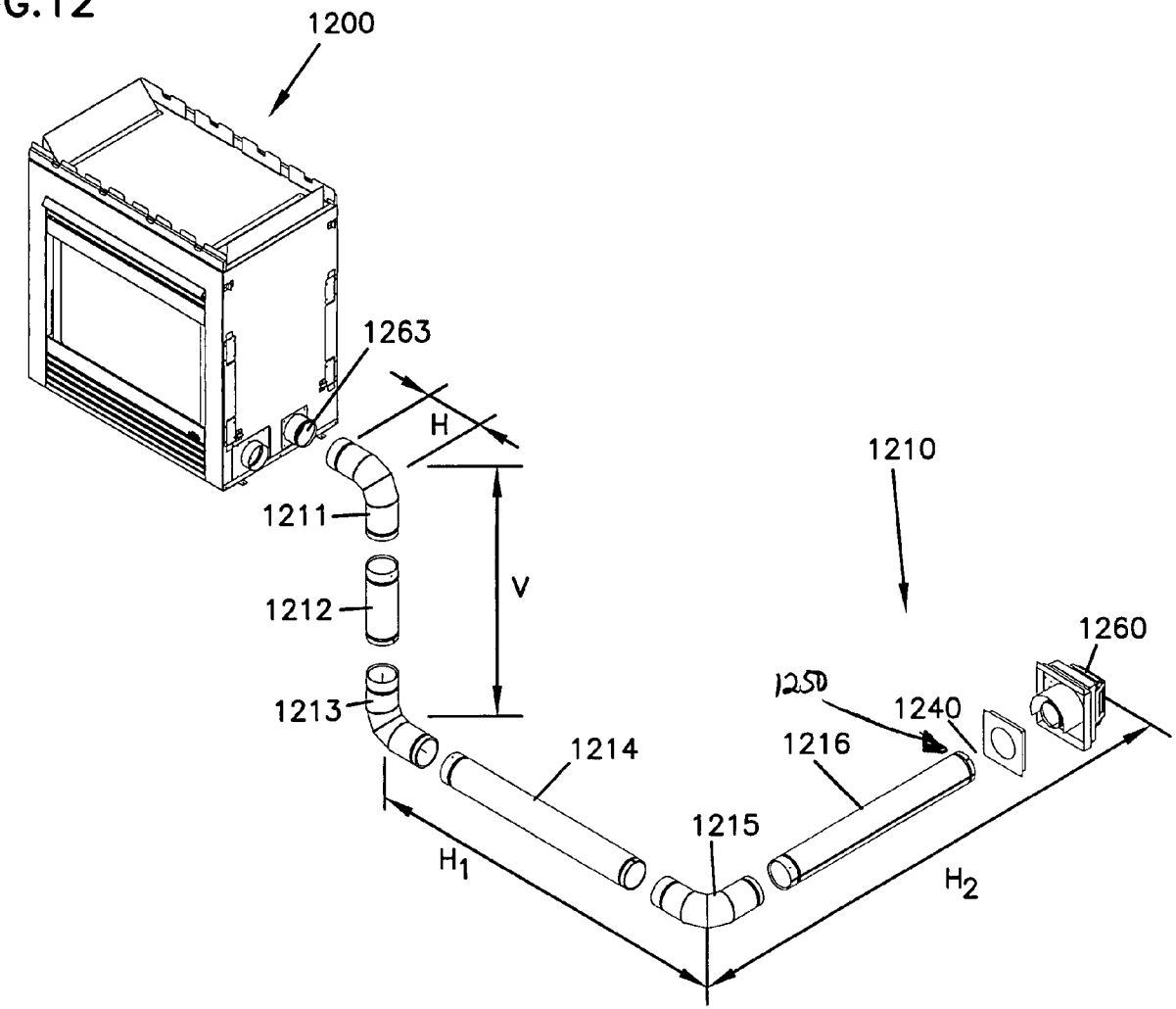
FIG. 12 is an example embodiment of a fireplace including a bottom vent having another example embodiment of a venting arrangement according to the present disclosure.

Referring to FIG. 12, a fireplace 1200 including a bottom vent 1263 coupled to ducting arrangement 1210 is shown. The bottom vent 1263 is fluidly coupled to a ducting arrangement 1210. The ducting arrangement 1210 includes a first 90-degree elbow 1211 connected to the bottom vent 1263. The first elbow 1211 is also connected to a downward section 1212 of pipe. The downward section 1212 is also connected to a second 90-degree elbow 1213. The second elbow 1213 directs the incoming downward vertical flow of combustion products into a first horizontal flow section 1214. The first horizontal flow section 1214 is also connected to a third 90-degree elbow 1215, which is in turn also connected to a second horizontal flow section 1216. The second horizontal flow section 1216 is also connected to a termination point 1240, which exhausts the combustion products through a horizontal vent 1250 covered by a horizontal vent cap 1260.

Using a blower that moves approximately 100 to 115 cubic feet of fluid per minute through the ducting arrangement shown, the total horizontal distance that the vent cap can be from the fireplace is about 35 feet, with a maximum downward distance of about 3 feet from the exhaust port to the vent cap.

Figure 13:
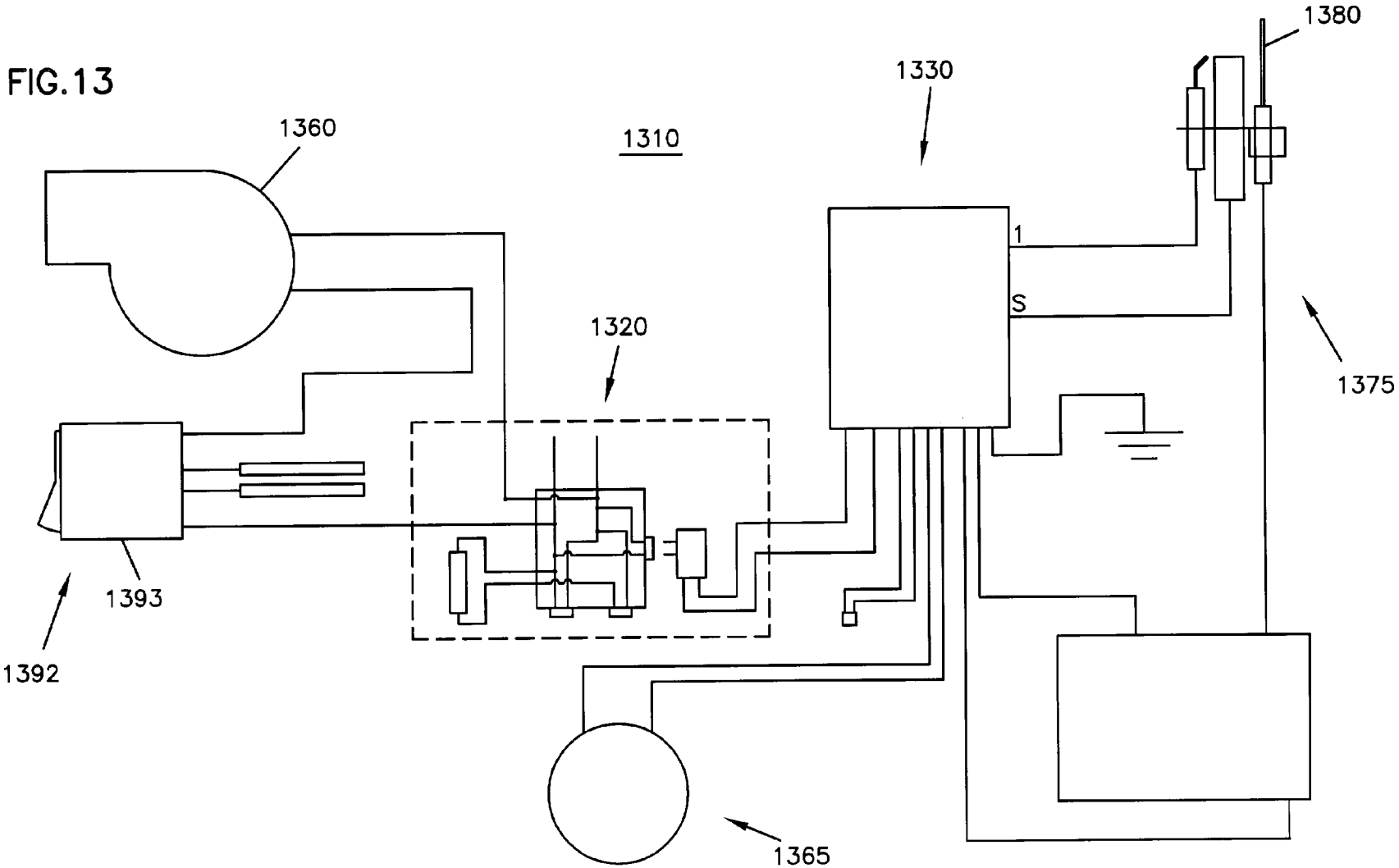
FIG. 13 is a schematic diagram of an example embodiment of a control system useful with a fireplace according to the present disclosure.

Referring to FIG. 13, an example embodiment of a controlled system 1310 for a fireplace (not shown) including a blower 1360 is shown. The example embodiment illustrated allows the pilot light 1380 to operate intermittently. The controlled system 1310 controls the blower 1360 and includes a junction box 1320, a pilot assembly 1375, an fluid flow sensor 1365, for example, a vacuum switch, an on/off assembly 1392 and an ignition module 1330. The on/off assembly 1392 is electrically in contact with an on/off device, such as a thermostat or a switch. The on/off assembly 1392 is connected in series with the blower 1360, insuring the blower 1360 is operating when the fireplace 1300 is on. The on/off assembly 1392 is also connected in series with the ignition module 1330. The ignition module 1330 controls the operation of the pilot assembly 1375. The pilot assembly 1375 includes a pilot light 1380 that burns only when operation of the fireplace is desired. The ignition module 1330 is also in communication with the flow sensor 1365. The fluid flow sensor 1365 monitors the fluid flow in the exhaust arrangement and insures that the blower 1360 is operating whenever the fireplace has combustion occurring.

The junction box 1320 includes apparatus (not shown) for terminating the wires. One of skill in the art will appreciate that the junction boxes used in fireplaces of the present disclosure are well known and that there are many possible configurations available. It is within the skill of one in the art to select a junction box for use with the other components that are included in the controlled system. Similarly, it is within the skill of one in the art to include in the junction box the various power sources that have the proper voltage to operate the devices that require power to operate.

Figure 14:
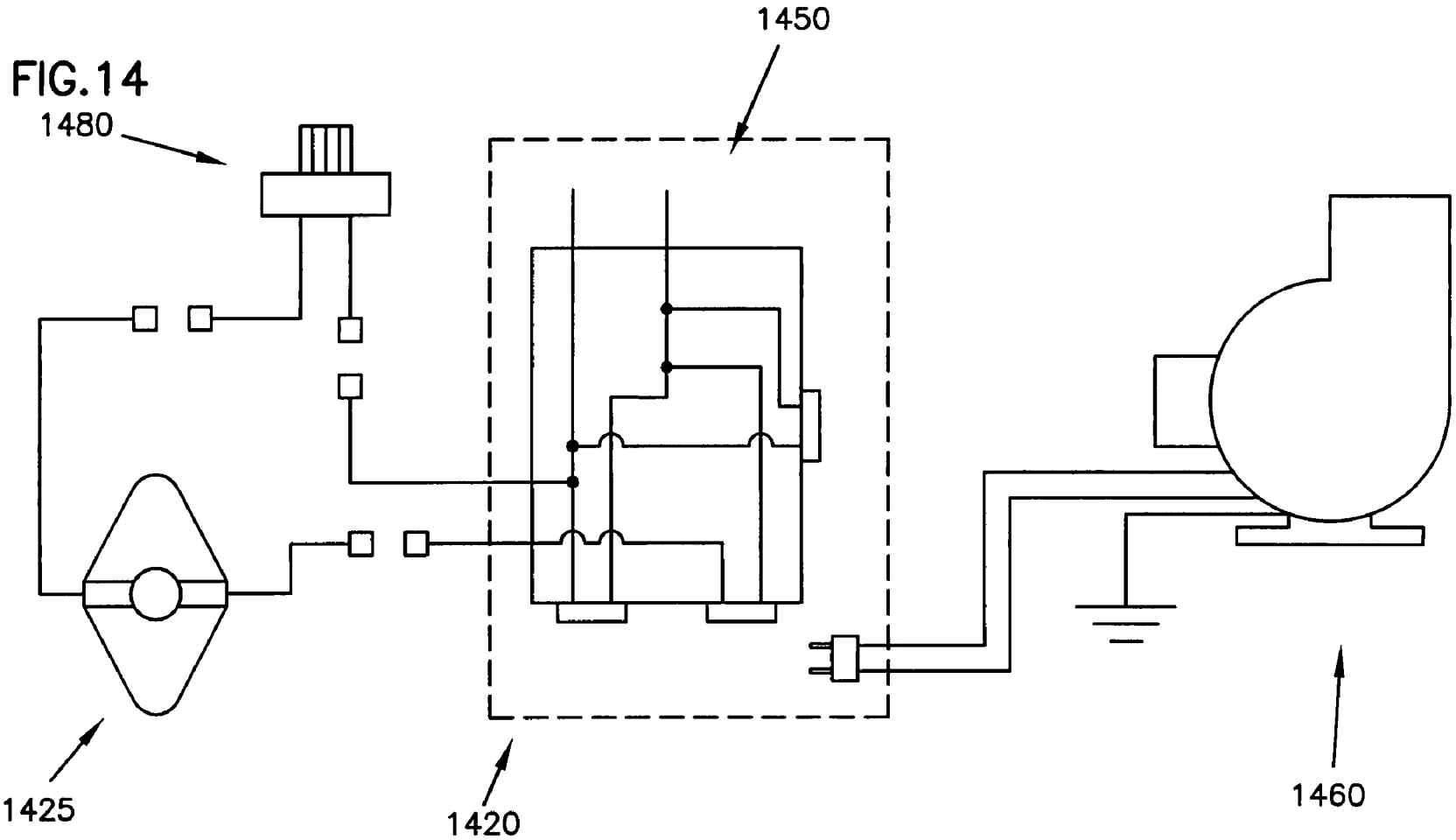
FIG. 14 is a schematic diagram of another example embodiment of a control system useful with a fireplace according to the present disclosure.
Figure 15B:
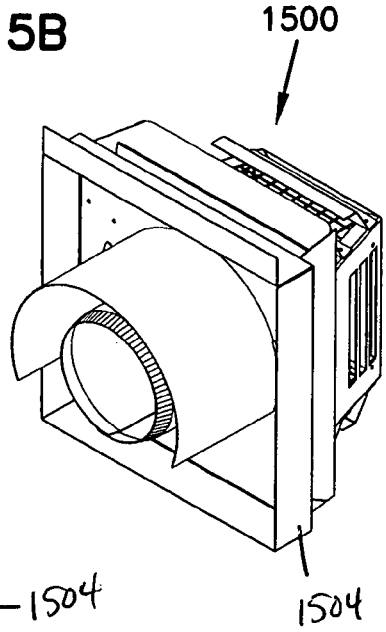
FIG. 15B is a perspective view of the vent cap of FIG. 15A according to the present disclosure.
Figure 15A:
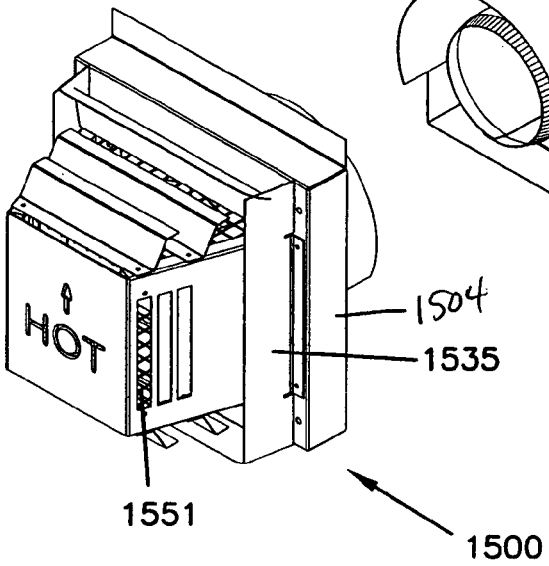
FIG. 15A is a perspective view of an example embodiment of a vent cap according to the present disclosure.
Figure 15C:
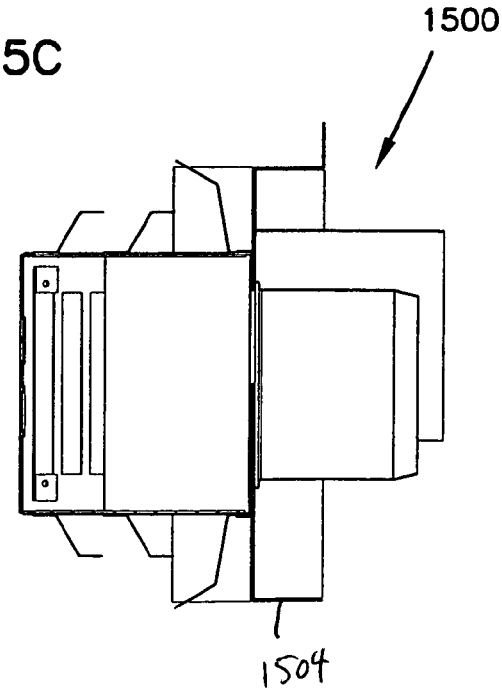
FIG. 15C is an elevation view of the vent cap of FIG. 15A according to the present disclosure.
Figure 15D:
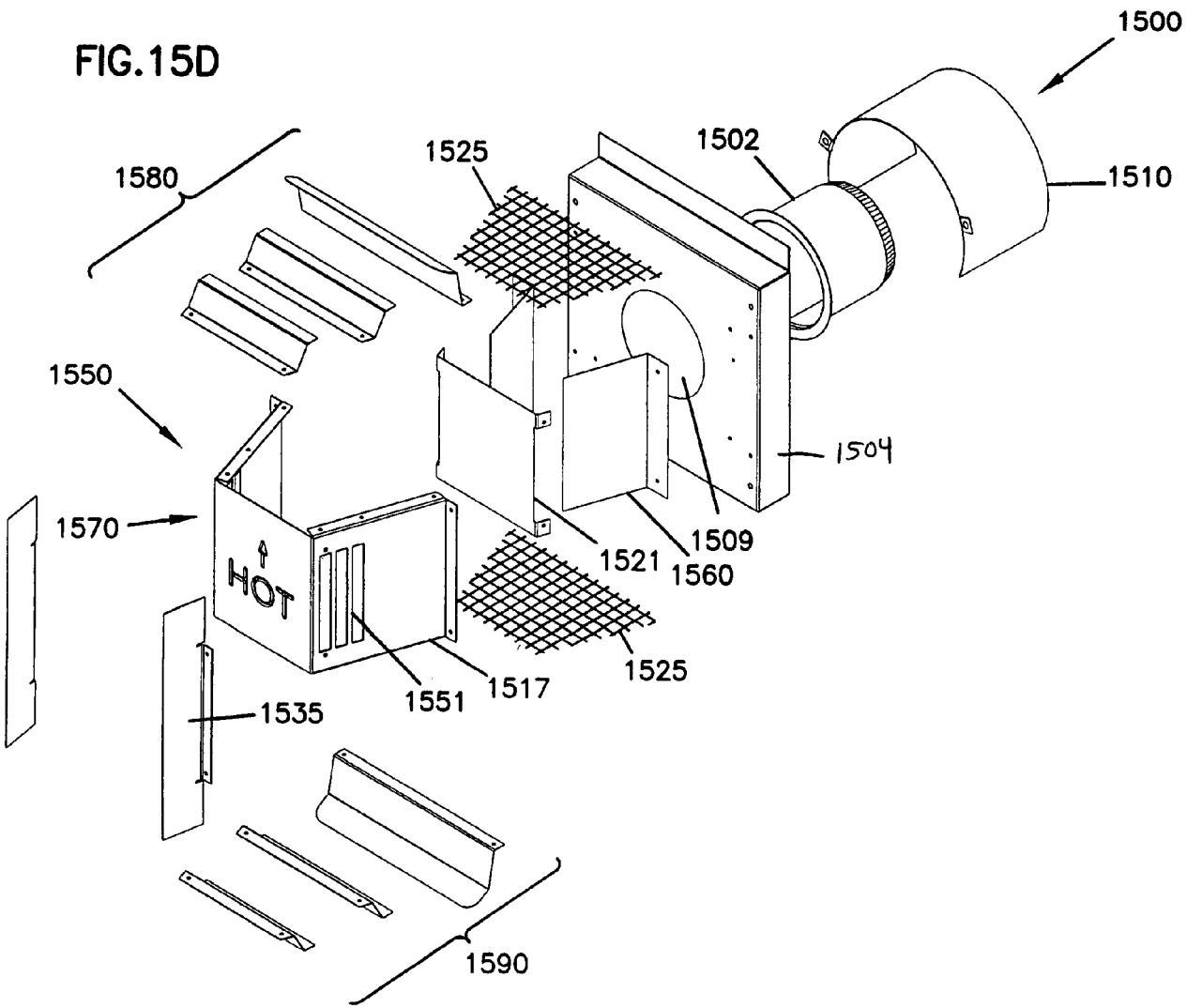
FIG. 15D is an exploded view of the vent cap of FIG. 15A according to the present disclosure.
Figure 16B:
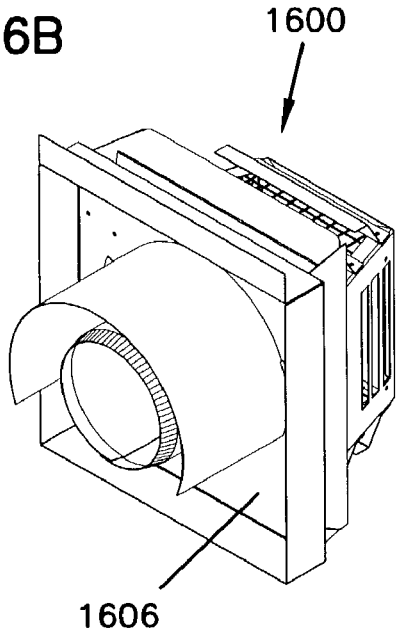
FIG. 16B is a perspective view of the vent cap of FIG. 16A according to the present disclosure.
Figure 16A:
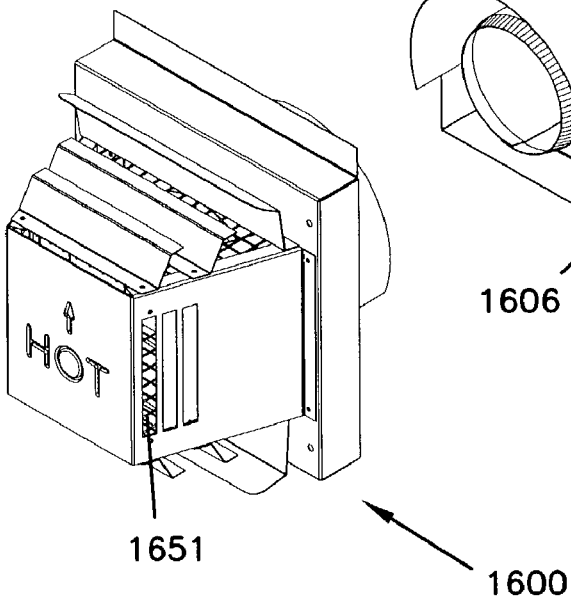
FIG. 16A is a perspective view of an example embodiment of a vent cap according to the present disclosure.
Figure 16C:
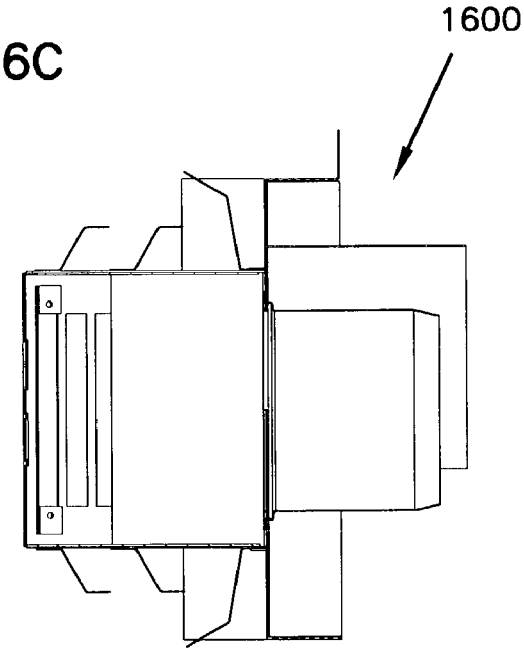
FIG. 16C is an elevation view of the vent cap of FIG. 16A according to the present disclosure.
Figure 16D:
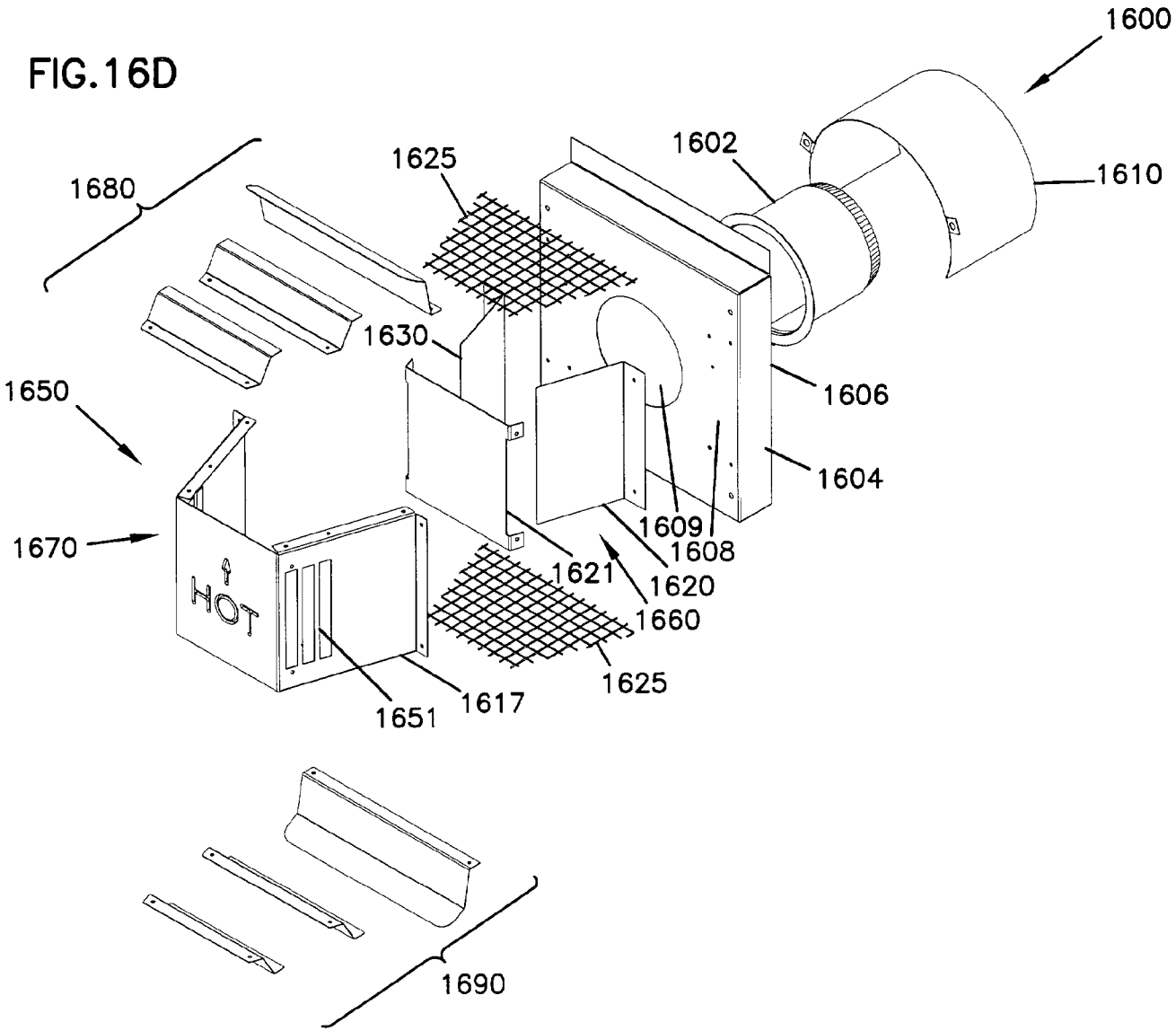
FIG. 16D is an exploded view of the vent cap of FIG. 16A according to the present disclosure.

Referring to FIG. 14, shown is a schematic for a controlled system for controlling a fluid flow through the fireplace (not shown) when it is operating. The fan or blower 1460 is connected to a power source 1450 in a junction box 1420. The speed of the blower 1460 is controlled using a speed control device 1480, for example, a rheostat. The speed control device 1480 is in communication with a temperature sensor 1425. While the temperature sensor 1425 is preferably located near the pilot assembly, one of skill in the art will appreciate that the location can vary depending on various factors, and it is within the skill of one in the art to select a proper location for the temperature sensor. The temperature sensor 1425 communicates with the speed control device 1480 to adjust the speed of the blower 1460. The blower 1460 exhausts the combustion products from the fireplace through a bottom vent.

Vent Cap

Referring to FIGS. 16A–16D, shown is an example embodiment of a horizontal venting arrangement 1600. The venting arrangement 1600 can be used with the fireplace of the present disclosure when the termination point of the ducting arrangement includes a horizontal termination opening to atmosphere. On the side coupled to the termination point, the venting arrangement 1600 includes a collar 1602 attached to a base 1604. The base 1604 includes a front 1608 and a back 1606 side. The back 1606 side faces the structure when the venting arrangement 1600 is installed. When the venting arrangement 1600 is mounted on the structure, the collar 1602 and base 1604 are installed inside of the structure. The base 1604 is coupled to the collar 1602 and pipe shield 1610. The base 1604 is typically mounted flush on the structure. The base 1604 is includes an opening 1609 that allows exhaust gases to vent from the ducting arrangement coupled to the venting arrangement 1600 to the atmosphere. The venting arrangement 1600 also includes a vent cap system 1650 coupled to the front side 1608 of the base 1604. The vent cap system 1650 includes a deflector arrangement 1660 and a cover arrangement 1670. Deflection arrangement 1660 includes two deflectors 1620, 1630, attached to the front 1608 of the base 1604. The deflectors 1620, 1630 are oriented to provide a converging angle in order to deflect fluid flow out of the collar 1602 which then impinges on plate 1621 and then through screens 1625 and then out of the cover arrangement 1670 through top and bottom louver assemblies 1680, 1690.

The deflector 1660 and cover 1670 arrangements cooperate to redirect fluid flow out of the collar 1602 to slow the fluid flow and cool the venting arrangement 1600. Fluid flow from the collar 1602 comes into the deflector arrangement 1660, where it is directed to the plate 1621 by the deflectors 1620, 1630. Fluid flow is then directed out of screens 1625 and passes through the cover arrangement 1670 and into the atmosphere.

The cover arrangement 1670 top and bottom louver assemblies 1680, 1690 direct the fluid flow from the deflector arrangement 1660 away from the structure to which the venting arrangement is attached. The shroud 1617 also includes side vent openings 1651 that allow fluid to assist in keeping the venting arrangement 1660 operating at a reduced temperature. Preferably, the materials for the components of the vent assembly are aluminized steel, but could also be any material that can withstand the physical and thermal operating environment, for example, galvanized steel or stainless steel.

Referring to FIGS. 15A–D, another example embodiment of a vent assembly is shown. The venting arrangement 1500 is similar to the venting arrangement 1600 shown in FIGS. 16A–D, in that it includes a collar 1502, an opening 1509, a pipe shield 1510, a plate 1521, screens 1525, a vent cap system 1550, a deflector arrangement 1560, a cover arrangement 1570, and top and bottom louver assemblies 1580, 1590. The venting arrangement 1500 also includes an additional pair of side shields 1535. The side shields 1535 are attached to the base 1504 and adjacent to the shroud 1517. The long axis of each shield 1535 is oriented in a vertical relationship to the base 1504. The side shields 1535 further reduce the operating surface temperature of the surface adjacent the shields 1535. Preferably, the side shields 1535 are made from vinyl, but made be made of any other suitable materials, the selection of which is within the ordinary skill of one in the art.

While particular embodiments have been described, it should be understood that the invention is not limited to the particular structure described. It is contemplated that the additional exhaust ducting arrangements or covers of the present disclosure may include many shapes and designs that would be useful in various structures having a fireplace. The foregoing description of the invention has been presented for purposes of illustration and description, and is not intended to be exhaustive or to limit the invention to the precise form disclosed. The description was selected to explain the principles of the invention in various embodiments and various modifications as are suited to the particular use contemplated. It is intended that the scope of the invention not be limited by the specification, but defined by the claims set forth below.

What is claimed is:

1. A fireplace system comprising:

a firebox defining a combustion chamber wherein combustion occurs to generate combustion products;

an exhaust port fluidly coupled to the firebox;

an upper exhaust plenum disposed above and in fluid communication with the combustion chamber;

an exhaust passage in fluid communication with the upper exhaust plenum and the exhaust port;

a source of fresh air, and a blower disposed between the exhaust port and the exhaust passage to assist in moving the combustion products through the upper exhaust plenum and the exhaust passage and into the exhaust port, and to draw fresh air from the fresh air source into the exhaust passage so as to mix the fresh air with the combustion products and to cool the removed combustion products;

wherein the source of fresh air is a room air intake vent of the fireplace system.

2. The system of claim 1 further comprising:

a ducting arrangement for exhausting combustion products from the firebox, the ducting coupled to the blower arrangement, wherein the ducting arrangement has at least one section where the combustion products move in a direction opposite the buoyant forces of the products.

3. The system of claim 2 further comprising:

a vent cap coupled to the ducting arrangement downstream of the blower for exhaust fireplace gases to the atmosphere.

4. The system of claim 1, further including a horizontal exhaust ducting arrangement coupled to the exhaust port.

5. The system of claim 1, wherein an inlet to the fresh air source is disposed below the combustion chamber.

6. The fireplace system of claim 1, wherein the source of fresh air is a combination of room air provided by a room air intake vent and outside air provided by an outside air vent.

7. The fireplace system of claim 1, wherein the blower is the only means of moving combustion products and fresh air in the fireplace system.

8. The fireplace system of claim 1, further comprising a bottom air guide that defines a fresh air inlet between the source of fresh air and the exhaust passage.

9. The fireplace system of claim 8, wherein the firebox includes a fresh air aperture in a bottom panel thereof, and the bottom air guide is positioned at least partially within the combustion chamber between the fresh air aperture and the exhaust passage.

10. An exhaust system for venting gases from a firebox defining a combustion chamber, the exhaust system comprising:

an intake manifold coupled to the combustion chamber for removing combustion gases from the combustion chamber;

an exhaust port located below the intake manifold and in fluid communication with the intake manifold;

a first source of fresh air in fluid communication with the combustion gases in the intake manifold;

a second source of fresh air in fluid communication with the combustion chamber;

means for creating a pressure differential of the gases between the intake manifold and the exhaust port, wherein combustion gases flow from the intake manifold to the exhaust port and fresh air flows from the first source of fresh air into the removed combustion gases to cool the removed combustion gases; and an exhaust duct arrangement for exhausting the gases, the exhaust duct arrangement including a first end coupled to the exhaust port and a second end located distally from the firebox.

11. The exhaust system of claim 10, wherein the means for creating a pressure differential is located below the firebox.

12. The exhaust system of claim 10, wherein the means for creating a pressure differential is a blower.

13. The exhaust system of claim 10, wherein the intake manifold further includes:

an upper exhaust guide coupled to the upper panel of the firebox to form the in manifold, the upper exhaust guide including an opening, wherein the upper exhaust guide interior is in direct fluid communication with the combustion chamber through the opening;

an exhaust passage in fluid communication between the upper exhaust guide and the exhaust port, wherein the combustion products move in a direction opposite the buoyant forces of the products within the exhaust passage.

14. The exhaust system of claim 13, wherein the means for creating a pressure differential is a blower located adjacent the exhaust port.

15. The exhaust system of claim 10, wherein the exhaust duct arrangement further includes a termination cap.

16. A fireplace comprising a firebox defining a combustion chamber wherein combustion gases are generated, the combustion chamber including upper and lower panels, first and second side panels, and a rear panel;

an exhaust passage defined between a side exhaust guide and the first side panel, and an upper exhaust guide having a first end and a second end, and wherein the upper exhaust guide is coupled to the upper panel defining an upper exhaust plenum therebetween, the upper exhaust guide defining at least one opening for the flow of combustion gases from the combustion chamber directly into the upper exhaust plenum, wherein the first end of the upper exhaust guide is in fluid communication with the exhaust passage, the upper exhaust guide is positioned within the combustion chamber, and the exhaust passage is positioned outside of the combustion chamber;

a blower arrangement in fluid communication with the exhaust passage, the blower arrangement coupled to the firebox for exhausting the combustion gases out of an exhaust port;

a fresh air source configured to provide a source of fresh air into the exhaust passage to mix with and cool the exhausted combustion gases; and insulation means at least partially disposed around the firebox.

17. The fireplace of claim 16, further including:

a ducting arrangement coupled to the exhaust port, the ducting arrangement including at least one horizontal section;

an elbow section connected to the horizontal section; and a downward section connected to the elbow section.

18. The fireplace of claim 16, wherein the insulation means includes material having sound dampening properties.

19. The fireplace of claim 16, wherein the fresh air source includes a fresh air inlet to the exhaust passage that is positioned at a location below the combustion chamber.

20. The fireplace of claim 16, further comprising a bottom air guide configured to provide a fluid passage between the inlet to the source of fresh air and an opening into the blower arrangement.

21. An exhaust system for venting gases from a firebox defining a combustion chamber, the exhaust system comprising:

an intake manifold coupled to the combustion chamber for removing combustion gases from the combustion chamber, the intake manifold including:

a channel coupled to the upper panel of the firebox, the channel including an opening, wherein the channel interior is in direct fluid communication with the combustion chamber through the opening;

an exhaust port located below the intake manifold and in fluid communication with the intake manifold;

a first source of fresh air in fluid communication with the combustion gases in the intake manifold;

a second source of fresh air in fluid communication with the combustion chamber; and means for creating a pressure differential of the combustion gases between the intake manifold and the exhaust port, wherein combustion gases flow from the intake manifold to the exhaust port and fresh air flows from the first source of fresh air into the removed combustion gases to cool the removed combustion gases;

wherein the intake manifold further includes an internal air passage in fluid communication between the intake manifold and the exhaust port, wherein the combustion products move in a direction opposite the buoyant forces of the products, within the internal air passage.

22. The exhaust system of claim 21, wherein the means for creating a pressure differential is a blower located adjacent the internal air passage.

23. The exhaust system of claim 21, wherein the means for creating a pressure differential is located below the firebox.

24. The exhaust system of claim 21, wherein the means for creating a pressure differential is a blower.

25. A fireplace system comprising:

a firebox defining a combustion chamber wherein combustion occurs to generate combustion products;

an exhaust port fluidly coupled to the firebox;

an upper exhaust plenum disposed above and in fluid communication with the combustion chamber;

an exhaust passage in fluid communication within the upper exhaust plenum and the exhaust port;

a source of fresh air; and a blower arrangement disposed between the exhaust port and the exhaust passage to assist in moving the combustion products through the upper exhaust plenum and the exhaust passage and into the exhaust port, and to draw fresh air from the fresh air source into the exhaust passage so as to mix the fresh air and the combustion products and to cool the removed combustion products;

wherein the source of fresh air is a combination of room air provided by a room air intake vent and outside air provided by an outside air vent.

26. The system of claim 25 further comprising a ducting arrangement for exhausting combusting products from the firebox, the ducting arrangement coupled to the blower arrangement, wherein the ducting arrangement has at least one section where the combustion products move in a direction opposite the buoyant forces of the products.

27. The system of claim 26 further comprising a vent cap coupled to the ducting arrangement downstream of the blower arrangement for exhausting fireplace gases to the atmosphere.

28. The system of claim 25, further including a horizontal exhaust ducting arrangement coupled to the exhaust port.

29. The system of claim 25 wherein an inlet to the fresh air source is disposed below the combustion chamber.

* * * * *

UNITED STATES PATENT AND TRADEMARK OFFICE

CERTIFICATE OF CORRECTION

PATENT NO. : 7,258,116 B2
APPLICATION NO. : 10/334697
DATED : August 21, 2007
INVENTOR(S) : Rebecca Ann Searcy It is certified that error appears in the above-identified patent and that said Letters Patent is hereby corrected as shown below:

Column 12
Line 58, delete "exhaust" and insert therefor --exhausting--

Column 13
Line 42, delete "in" and insert therefor --intake--

Signed and Sealed this

Eighth Day of July, 2008

JON W. DUDAS
*Director of the United States Patent and Trademark Office*